US010377136B2

(12) United States Patent
Miyagishi et al.

(10) Patent No.: US 10,377,136 B2
(45) Date of Patent: Aug. 13, 2019

(54) LIQUID EJECTING HEAD AND LIQUID EJECTING APPARATUS

(71) Applicant: SEIKO EPSON CORPORATION, Tokyo (JP)

(72) Inventors: Akira Miyagishi, Matsumoto (JP); Shunya Fukuda, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 26 days.

(21) Appl. No.: 15/335,214

(22) Filed: Oct. 26, 2016

(65) Prior Publication Data

US 2017/0120589 A1 May 4, 2017

(30) Foreign Application Priority Data

Oct. 30, 2015 (JP) ..... 2015-214958

(51) Int. Cl.
*B41J 2/14* (2006.01)

(52) U.S. Cl.
CPC ..... *B41J 2/1433* (2013.01); *B41J 2/14233* (2013.01); *B41J 2002/14419* (2013.01); *B41J 2202/11* (2013.01)

(58) Field of Classification Search
CPC ..... B41J 2/1433; B41J 2/14233; B41J 2002/14419; B41J 2202/11; B41J 2/14; B41J 2/14032; B41J 2/14209; B41J 2/14314; B41J 2002/14217; B41J 2002/14225; B41J 2002/14459; B41J 2002/14483
See application file for complete search history.

(56) References Cited

U.S. PATENT DOCUMENTS

2007/0091150 A1* 4/2007 Kodama ..... B41J 2/04543 347/68
2008/0062225 A1* 3/2008 Matsuzawa ..... B41J 2/14233 347/65
2008/0231668 A1* 9/2008 Tamada ..... B41J 2/14209 347/71
2013/0070025 A1 3/2013 Kuwata
2013/0233939 A1* 9/2013 Uezawa ..... B41J 2/14274 239/102.1

(Continued)

FOREIGN PATENT DOCUMENTS

JP 2005-034997 2/2005
JP 2011-131571 7/2011

(Continued)

*Primary Examiner* — Scott A Richmond
(74) *Attorney, Agent, or Firm* — Workman Nydegger

(57) ABSTRACT

A liquid ejecting head includes: a first pressure generation chamber communicating with a first nozzle opening via a first communication path, and a second pressure generation chamber communicating with a second nozzle opening via a second communication path. The first and second pressure generation chambers are aligned in a first direction. The first communication path includes, on one side of a second direction, a first oblique portion with a section area changing from a side of the first pressure generation chamber toward the first nozzle opening. The second communication path includes, on the other side of the second direction, a second oblique portion with a section area changing from a side of the second pressure generation chamber toward the second nozzle opening.

10 Claims, 12 Drawing Sheets

(56) References Cited

U.S. PATENT DOCUMENTS

2015/0028125 A1* 1/2015 Fukuda ..... B41J 2/14201
239/102.2

FOREIGN PATENT DOCUMENTS

| | | |
|---|---|---|
| JP | 2012-152970 | 8/2012 |
| JP | 2013-063590 | 4/2013 |
| JP | 2013-123882 | 6/2013 |

* cited by examiner

LIQUID EJECTING HEAD AND LIQUID EJECTING APPARATUS

The entire disclosure of Japanese Patent Application No: 2015-214958, filed Oct. 30, 2015 is expressly incorporated by reference herein in its entirety.

BACKGROUND

1. Technical Field

The present invention relates to a liquid ejecting head and a liquid ejecting apparatus that eject liquid from nozzle openings, and particularly to an ink jet recording head and an ink jet recording apparatus that eject ink as the liquid.

2. Related Art

Representative examples of a liquid ejecting head that ejects liquid droplets include an ink jet recording head that ejects ink droplets. An ink jet recording head that includes a flow path forming substrate in which pressure generation chambers communicating with nozzle openings are formed and a drive element, such as a piezoelectric actuator, provided on a one surface side of the flow path forming substrate and ejects ink from the nozzle openings by the drive element generating variations in pressure of the ink in the pressure generation chambers, for example, is known.

If the nozzle openings are arranged at high density in such an ink jet recording head, flow paths communicating with the nozzle openings are also arranged at high density, which brings about degradation in rigidity of sectioning walls between adjacent flow paths, variations in ink ejecting properties due to crosstalk of the sectioning walls, and degradation in printing quality. If the nozzle openings are arranged at high density, ink droplets ejected from adjacent nozzle openings roll up wind and cause degradation in printing quality due to deviation of ink droplet landing positions.

Therefore, an ink jet recording head has been proposed which reduces crosstalk due to deformation of the sectioning walls by employing a so-called staggered arrangement in which the adjacent nozzle openings are made to alternately deviate in a direction orthogonal to an alignment direction of the nozzle openings to enhance the rigidity of the sectioning walls between the flow paths communicating with the nozzle openings (see JP-A-2013-123882, JP-A-2012-152970, and JP-A-2013-063590, for example).

However, arrangement of the flow paths with deviations in accordance with the arrangement of the nozzle openings causes a problem that the flow paths cannot be formed with high precision, which brings about degradation in shape stability of the flow paths, variations in the ink ejecting properties, and degradation in printing quality.

Arrangement of the nozzle openings with deviations causes a portion where an ink flow stagnates and causes a problem that air bubbles accumulated in the portion where the ink flow stagnates absorb variations in pressure, thus the ink ejecting properties are degraded, and ejection failures occur.

Not only the ink jet recording head but also liquid ejecting heads that eject liquid other than ink also have such problems.

SUMMARY

An advantage of some aspects of the invention is to provide a liquid ejecting head and a liquid ejecting apparatus that can enhance printing quality.

According to an aspect of the invention, there is provided a liquid ejecting head including: a pressure chamber substrate that includes a plurality of pressure generation chambers; a nozzle plate that includes a plurality of nozzle openings; and a plurality of communication paths that are flow paths connecting the respective pressure generation chambers and the respective nozzle openings and have oblique portions with section areas changing from inlets on a side of the pressure generation chambers toward outlets on a side of the nozzle openings, in which the oblique portions are arranged in the communication paths on the side of the pressure generation chambers or the side of the nozzle openings in a third direction, the plurality of pressure generation chambers are aligned in a first direction and include a first pressure generation chamber and a second pressure generation chamber that are adjacent to each other in the first direction, the first pressure generation chamber communicates with a first nozzle opening from among the nozzle openings via a first communication path from among the plurality of communication paths, the second pressure generation chamber communicates with a second nozzle opening from among the nozzle openings via a second communication path from among the plurality of communication paths, the first communication path includes, on one side of a second direction, a first oblique portion with a section area changing from a side of the first pressure generation chamber toward the first nozzle opening, the second communication path includes, on the other side of the second direction, a second oblique portion with a section area changing from a side of the second pressure generation chamber toward the second nozzle opening, the first direction is orthogonal to the second direction on the nozzle plate, and the third direction is a direction orthogonal to both the first direction and the second direction.

According to this aspect, it is possible to differentiate the positions of the first communication path and the second communication path in the second direction Y and to differentiate the positions of the first nozzle opening and the second nozzle opening in the second direction Y by providing the first oblique portion in the first communication path on the one side of the second direction and providing the second oblique portion in the second communication path on the other side of the second direction Y. Therefore, it is possible to enhance rigidity of a sectioning wall between the first communication path and the second communication path and to thereby reducing crosstalk by differentiating the positions of the first communication path and the second communication path in the second direction Y. In addition, it is possible to suppress wind patterns from being formed by an influence of liquid droplets ejected from the mutually adjacent nozzle openings by differentiating the positions of the first nozzle opening and the second nozzle opening in the second direction Y.

It is preferable that one of an inlet and an outlet of each communication path is arranged inside the other in a plan view from the third direction. In doing so, such a configuration of the communication paths makes it possible to enhance processing precision of the communication paths, to form the communication paths into stable shapes with less variation, and to suppress variations in liquid ejecting properties caused by the variations in shapes.

It is preferable that the first oblique portion has a section area reduced from the side of the first pressure generation chamber toward the side of the first nozzle opening, that the second oblique portion has a section area reduced from the side of the second pressure generation chamber toward the side of the second nozzle opening, that the first communication path includes, on a downstream side of the first oblique portion, a first linear portion with a uniform section area from the side of the first pressure generation chamber toward the side of the first nozzle opening, and that the second communication path includes, on a downstream side of the second oblique portion, a second linear portion with a uniform section area from the side of the second pressure generation chamber toward the side of the second nozzle opening. In doing so, it is possible to separate the first linear portion and the second linear portion in the second direction Y and to thereby further enhance the rigidity of the sectioning wall between the first communication path and the second communication path.

It is preferable that a clearance between the first nozzle opening and the second nozzle opening is wider than a clearance between the first pressure generation chamber and the second pressure generation chamber in the second direction. In doing so, it is possible to suppress wide patterns from being formed by influences of the liquid droplets ejected from the mutually adjacent nozzle openings by differentiating the positions of the first nozzle opening and the second nozzle opening in the second direction Y.

It is preferable that the plurality of communication paths are provided on a substrate laminated on the pressure chamber substrate. In doing so, it is possible to suppress sagging and the like caused by etching and to easily and precisely form the pressure generation chambers and the communication paths as compared with a case where the pressure generation chambers and the communication paths are provided on the same member.

It is preferable that the liquid ejecting head further includes: a communication plate in which the communication paths are provided; a manifold substrate that is laminated on the communication plate and includes a manifold communicating with the plurality of pressure generation chambers; and a plurality of supply communication paths that establish communication between the manifold and the pressure generation chambers, that the first pressure generation chamber communicates with the manifold via a first supply communication path from among the plurality of supply communication paths, that the second pressure generation chamber communicates with the manifold via a second supply communication path from among the plurality of supply communication paths, and that a clearance between the first supply communication path and the second supply communication path is wider than a clearance between the first pressure generation chamber and the second pressure generation chamber in the second direction. In doing so, it is possible to enhance the rigidity of the sectioning wall between the first supply communication path and the second supply communication path and to reduce crosstalk of the sectioning wall.

According to another aspect of the invention, there is provided a liquid ejecting apparatus including: the liquid ejecting head as described above.

According to such an aspect, it is possible to realize the liquid ejecting apparatus with enhanced printing quality.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, detailed description will be given of the invention based on embodiments.

First Embodiment

Figure 1:
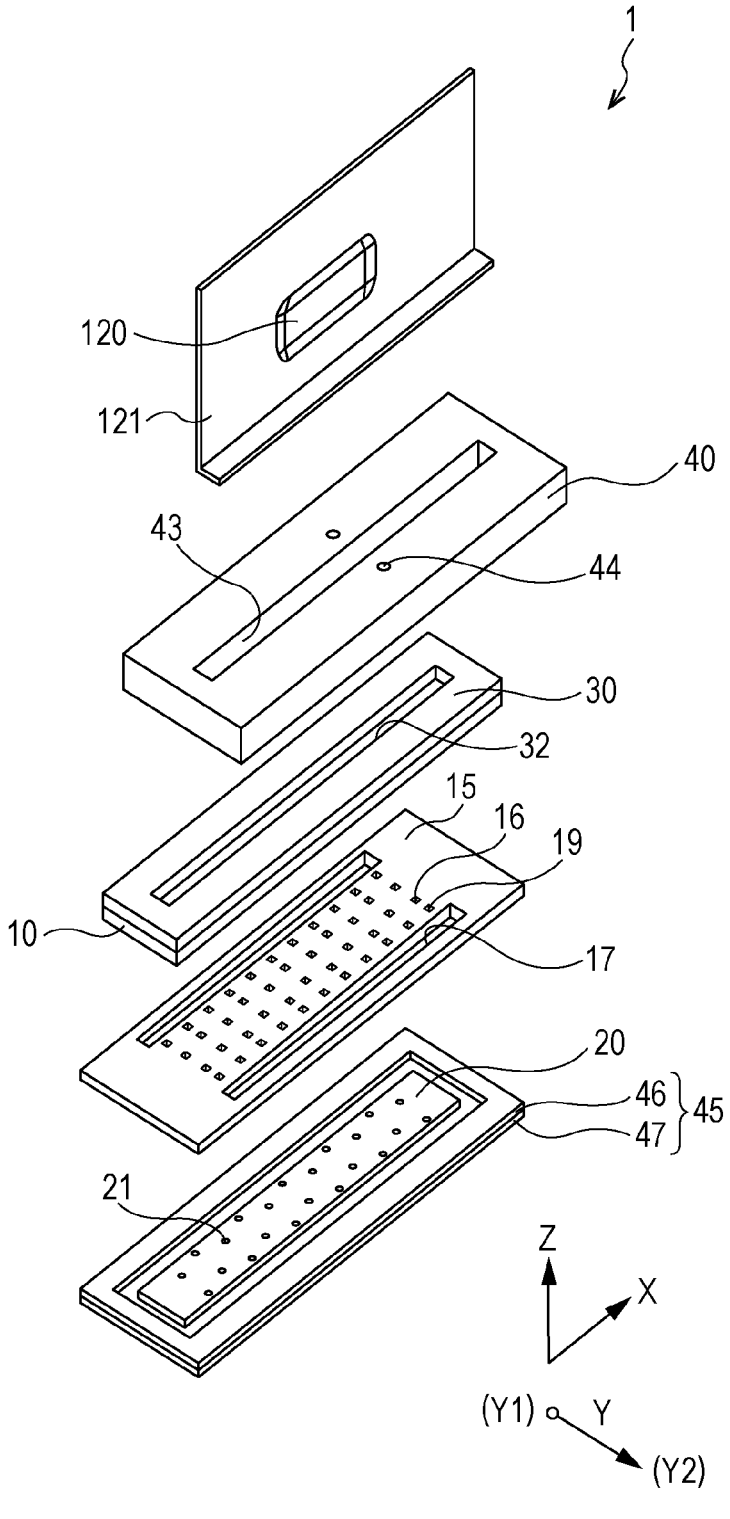
FIG. 1 is a developed perspective view of a recording head according to a first embodiment of the invention.
Figure 2:
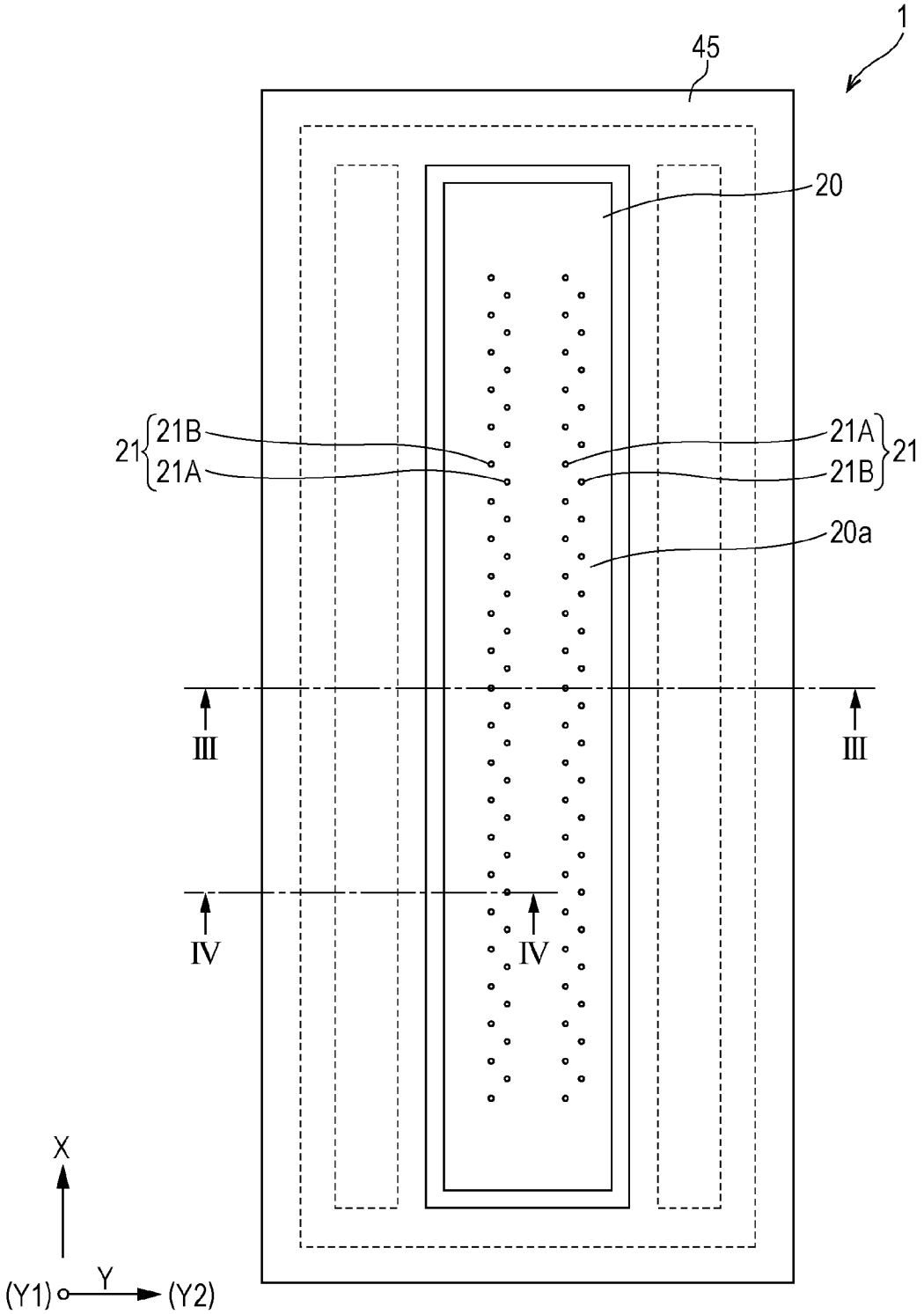
FIG. 2 is a plan view of the recording head according to the first embodiment of the invention.
Figure 3:
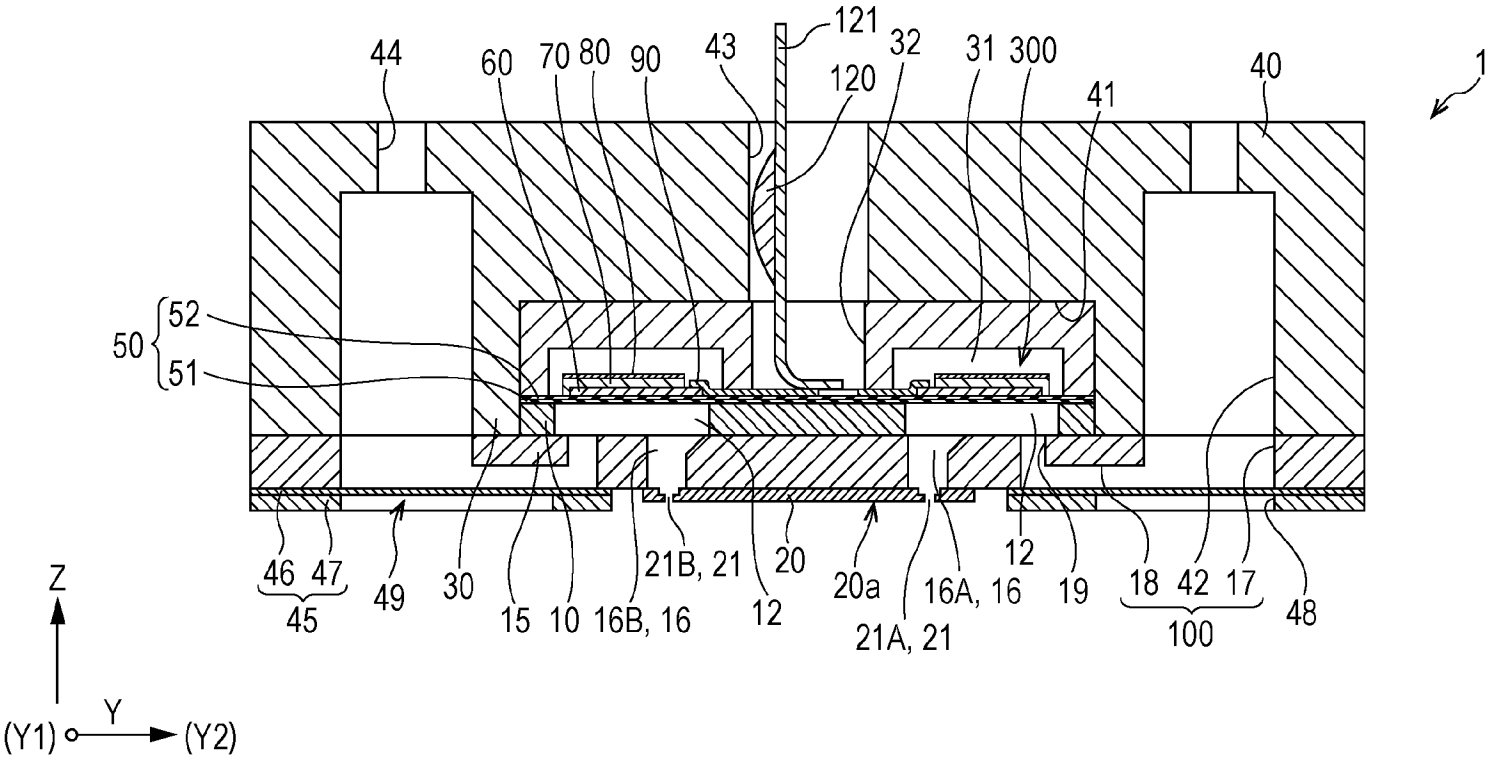
FIG. 3 is a sectional view of the recording head according to the first embodiment of the invention.
Figure 4:
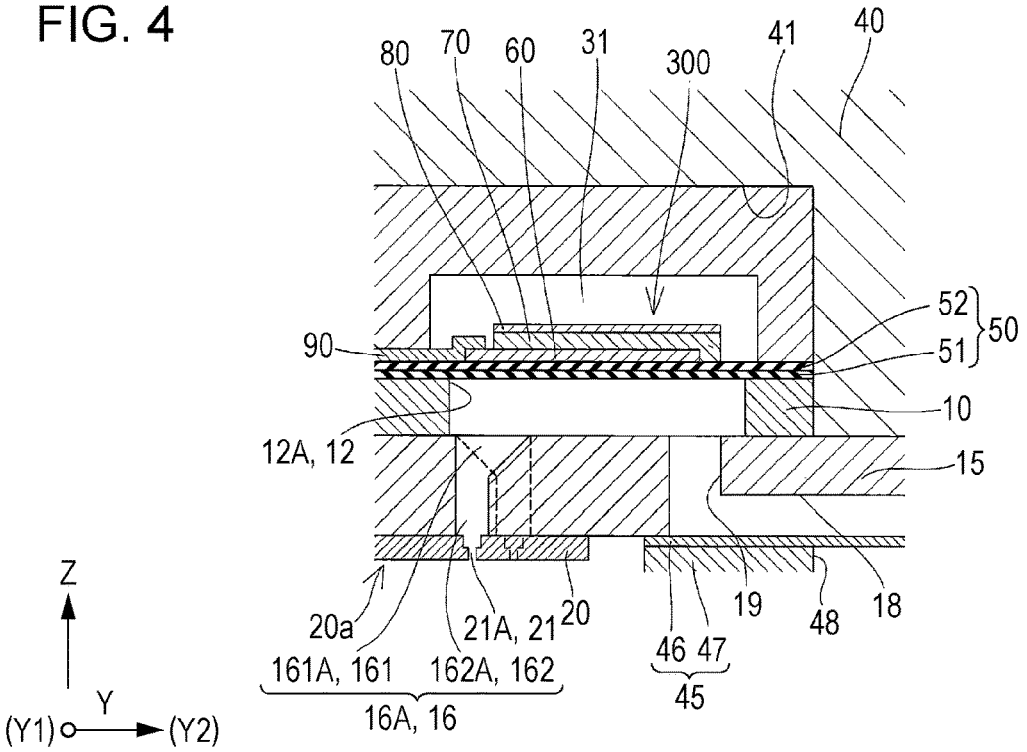
FIG. 4 is an enlarged sectional view of main parts of the recording head according to the first embodiment of the invention.

FIG. 1 is an exploded perspective view of an ink jet recording head as an example of a liquid ejecting head according to a first embodiment of the invention, FIG. 2 is a plan view of main parts of a flow path forming substrate in the ink jet recording head, FIG. 3 is a sectional view taken along the line III-III in FIG. 2, and FIG. 4 is a sectional view taken along the line IV-IV in FIG. 2.

As illustrated in the drawings, pressure generation chambers 12 sectioned by a plurality of sectioning walls are aligned on a flow path forming substrate 10, which is a pressure chamber substrate according to the embodiment that forms an ink jet recording head 1 according to the embodiment (hereinafter, also simply referred to as a recording head 1), along a direction in which a plurality of nozzle openings 21 for ejecting ink are aligned by performing anisotropic etching from a one surface side. Hereinafter, the direction will be referred to as an alignment direction of the pressure generation chambers 12 or a first direction X. The flow path forming substrate 10 is provided with a plurality of arrays, two arrays in the embodiment, in which the pressure generation chambers 12 are aligned in the first direction X. The array arrangement direction in which the plurality of arrays of the pressure generation chambers 12 are arranged will be referred to as a second direction Y. That is, the first direction X and the second direction Y are orthogonal to each other on a nozzle plate 20, which will be described later in detail. Furthermore, a direction that is orthogonal to both the first direction X and the second direction Y will be referred to as a third direction Z. Any configurations in which the pressure generation chambers 12 are aligned in the first direction X are applicable as long as the alignment direction of the pressure generation chambers 12 have a component (vector) directed toward the first direction X, and the pressure generation chambers 12 may be aligned in a direction inclined with respect to the first direction X.

On a side of one surface of such a flow path forming substrate 10 in the third direction Z, a communication plate 15 and the nozzle plate 20 are sequentially laminated.

The nozzle plate 20 includes nozzle openings 21 formed therein so as to communicate with the respective pressure generation chambers 12 via communication paths 16 provided on the communication plate 15. Since two arrays of the pressure generation chambers 12 aligned in the first direction X are provided in the second direction Y in the embodiment, two nozzle opening groups of the nozzle openings 21 aligned in the first direction X are aligned in the second direction Y. The nozzle openings 21 forming such respective nozzle opening groups eject the same type of ink (liquid).

Here, the plurality of nozzle openings 21 forming the respective nozzle opening groups are arranged in a staggered manner along the first direction X. That is, the nozzle openings 21 that are mutually adjacent to each other in the first direction X are arranged with deviations in the second direction Y in the nozzle opening groups.

Specifically, two arrays of nozzle openings 21 that are aligned in the first direction X at the same position in the second direction Y are aligned in the second direction Y, and arrays of the nozzle openings 21 arranged at different positions in the second direction Y are arranged with deviation of a half pitch of the nozzle openings 21 in the first direction X. In doing so, the nozzle openings 21 in the nozzle opening groups are arranged in the staggered manner along the first direction X. In the embodiment, the nozzle openings 21 provided on a side on which the two nozzle opening groups approach each other in the second direction Y will be referred to as first nozzle openings 21A, and the nozzle openings 21 provided on a side on which the two nozzle opening groups are distant away from each other will be referred to as second nozzle openings 21B. That is, the nozzle openings 21 provided on a side of Y1 in the second direction will be referred to as first nozzle openings 21A, and the nozzle openings 21 provided on a side of Y2 will be referred to as second nozzle openings 21B from among the nozzle opening groups provided on the side of Y2 in the second direction.

Arrays of pressure generation chamber 12 aligned in the first direction X are formed with respect to the nozzle opening groups in which the first nozzle openings 21A and the second nozzle openings 21B are alternately arranged as described above. The plurality of pressure generation chambers 12 corresponding to the respective nozzle opening groups have the same length in the second direction Y and are arranged at the same position in the second direction Y in the embodiment. That is, a first pressure generation chamber 12A communicating with the first nozzle openings 21A and a second pressure generation chamber 12B communicating with the second nozzle openings 21B have the same length in the second direction Y and are arranged at the same position in the second direction Y. That is, the first nozzle openings 21A and the second nozzle openings 21B are arranged to have a clearance wider than the clearance between the first pressure generation chamber 12A and the second pressure generation chamber 12B in the second direction Y. In addition, the clearance between the first nozzle openings 21A and the second nozzle openings 21B and the clearance between the first pressure generation chamber 12A and the second pressure generation chamber 12B represent intervals between gravity centers, respectively. In the embodiment, the first nozzle openings 21A and the second nozzle openings 21B are arranged so as to have the same clearance as that between the first pressure generation chamber 12A and the second pressure generation chamber 12B or with no clearance therebetween in the first direction X.

The communication plate 15 is provided with communication paths 16 that establish communication between the pressure generation chambers 12 and the nozzle openings 21 as described above. The communication plate 15 has a larger area than that of the flow path forming substrate 10, and the nozzle plate 20 has a smaller area than that of the flow path forming substrate 10. Since the nozzle openings 21 of the nozzle plate 20 can be separated from the pressure generation chambers 12 by providing the communication plate 15 as described above, ink in the pressure generation chambers 12 are not easily affected by an increase in viscosity of the ink in the vicinities of the nozzle openings 21 due to evaporation of moisture in the ink. It is only necessary for the nozzle plate 20 to cover the openings of the communication paths 16 that establish communication between the pressure generation chambers 12 and the nozzle openings 21. Therefore, it is possible to relatively reduce the area of the nozzle plate 20 and to thereby reduce the cost. A surface, in which the nozzle openings 21 are opened, from which ink droplets are ejected, of the nozzle plate 20 will be referred to as a liquid ejecting surface 20*a* in the embodiment.

Here, the communication paths 16 that establish communication between the pressure generation chambers 12 and the nozzle openings 21 are flow paths along straight lines extending in the third direction Z and include oblique portions 161 with section areas changing from inlets on the side of the pressure generation chambers 12 toward outlets on the side of the nozzle openings 21.

Specifically, the communication paths 16 according to the embodiment include the oblique portions 161 with the section areas changing from the inlets on the side of the pressure generation chambers 12 toward the outlets on the side of the nozzle openings 21 and linear portions 162 with uniform section areas from the inlets on the side of the pressure generation chambers 12 toward the outlets on the side of the nozzle openings 21.

Figure 5:
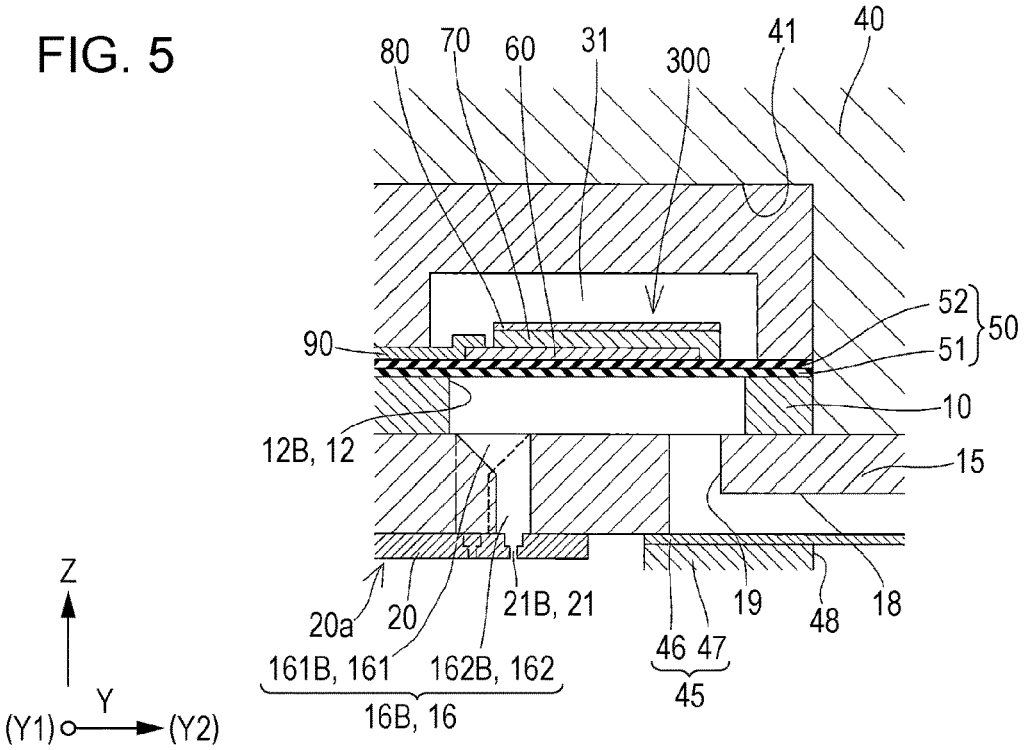
FIG. 5 is an enlarged sectional view of main parts of the recording head according to the first embodiment of the invention.

From among such communication paths 16, the communication path 16 that establishes communication between the first nozzle opening 21A and the first pressure generation chamber 12A as illustrated in FIG. 4 will be referred to as a first communication path 16A, and the communication path 16 that establishes communication between the second nozzle opening 21B and the second pressure generation chamber 12B as illustrated in FIG. 5 will be referred to as a second communication path 16B. That is, the first pressure generation chamber 12A communicates with the first nozzle opening 21A via the first communication path 16A, and the second pressure generation chamber 12B communicates with the second nozzle opening 21B via the second communication path 16B.

Here, detailed description will be given of the nozzle opening groups with the first communication paths 16A and the second communication path 16B on the side of Y2. The first communication path 16A includes a first oblique portion 161A as the oblique portion 161 and a first linear portion 162A as the linear portion 162 as illustrated in FIG. 4. The first oblique portion 161A is provided on the side of the first pressure generation chamber 12A in the third direction Z and is provided such that the section area thereof is reduced from the inlet on the side of the first pressure generation chamber 12A toward the outlet on the side of the first nozzle opening 21A. The first linear portion 162A is provided on the downstream side of the first oblique portion 161A, namely the side of the first nozzle opening 21A and is provided such that the section area thereof is uniform from the side of the first pressure generation chamber 12A toward the side of the first nozzle opening 21A. The first oblique portion 161A is formed by gradually increasing the width of the opening on the side of Y2 in the second direction Y with respect to the first linear portion 162A toward the side of the pressure generation chamber 12 in the third direction Z. That is, the first oblique portion 161A is provided on the side of Y2 that corresponds to the one side of the second direction Y. That is, as for inner wall surfaces on both sides of the first oblique portion 161A in the second direction Y, the inner wall on the side of Y1 is formed on a straight line along the third direction Z, and the inner wall on the side of Y2 is provided so as to be inclined with respect to the third direction Z. In doing so, the first oblique portion 161A is formed such that the width of a portion connected with the first pressure generation chamber 12A is wider on the side of Y2 than the width of a portion connected with the first linear portion 162A.

The second communication path 16B includes a second oblique portion 161B as the oblique portion 161 and a second linear portion 162B as the linear portion 162 as illustrated in FIG. 5. The second oblique portion 161B is provided on the side of the second pressure generation chamber 12B in the third direction Z and is provided such that the section area thereof is reduced from the inlet on the side of the second pressure generation chamber 12B toward the outlet on the side of the second nozzle opening 21B. The second linear portion 162B is provided on the downstream side of the second oblique portion 161B, namely the side of the second nozzle opening 21B and is provided such that the section area is uniform from the side of the second pressure generation chamber 12B toward the side of the second nozzle opening 21B. In addition, the second oblique portion 161B is formed by increasing the width of the opening on the side of Y2 in the second direction Y with respect to the second linear portion 162B. That is, the second oblique portion 161B is provided on the side of Y1 that corresponds to the other side of the second direction Y. That is, as for inner wall surfaces on both sides of the second oblique portion 161B in the second direction Y, the inner wall on the side of Y2 is formed on a straight line along the third direction Z, and the inner wall on the side of Y1 is provided so as to be inclined with respect to the third direction Z. In doing so, the second oblique portion 161B is formed such that the width of a portion connected with the second pressure generation chamber 12B is wider on the side of Y1 than the width of a portion connected with the second linear portion 162B.

It is possible to provide the first linear portion 162A that communicates with the first oblique portion 161A and the second linear portion 162B that communicates with the second oblique portion 161B at different positions in the second direction Y by providing the first oblique portion 161A of the first communication path 16A on the side of Y2 and providing the second oblique portion 161B of the second communication path 16B on the side of Y1 as descried above. Here, any configurations in which the first linear portion 162A and the second linear portion 162B are provided at different positions in the second direction Y may be employed as long as at least a part of the first linear portion 162A and a part of the second linear portion 162B do not face each other in the first direction X. That is, any configurations may be employed as long as the entirety of the first linear portion 162A and the entirety of the second linear portion 162B are not positioned at the completely same position in the second direction Y, and a part of the first linear portion 162A and a part of the second linear portion 162B may face each other in the first direction X. In the embodiment, the first linear portion 162A and the second linear portion 162B are arranged at such positions that the entirety of the first linear portion 162A and the entirety of the second linear portion 162B do not face each other in the first direction X.

It is possible to suppress complete overlapping of the first communication path 16A and the second communication path 16B in the first direction X by arranging at least a part of the first communication path 16A and a part of the second communication path 16B at different positions in the second direction Y as described above. In doing so, it is possible to enhance the rigidity of the sectioning wall between the first communication path 16A and the second communication path 16B. That is, if the first communication path 16A and the second communication path 16B are arranged at the same position in the second direction Y, the thickness of the entire sectioning wall between the first communication path 16A and the second communication path 16B that are adjacent to each other in the first direction X becomes thin. In contrast, since the first linear portion 162A of the first communication path 16A and the second linear portion 162B of the second communication path 16B are arranged at different positions in the second direction Y, it is possible to reduce the area in which the sectioning wall between the first communication path 16A and the second communication path 16B in the first direction X is thin and to enhance the rigidity of the sectioning wall. That is, since a portion of the sectioning wall with no second linear portion 162B provided faces the first linear portion 162A in the first direction X, and a portion with no first linear portion 162A provided faces the second linear portion 162B in the first direction X, it is possible to enhance the rigidity of the sectioning wall between the first communication path 16A and the second communication path 16B. It is possible to suppress cross streak due to deformation of the sectioning wall by enhancing the rigidity of the sectioning wall between the first communication path 16A and the second communication path 16B as described above. Here, in a case where ink droplets are ejected from a single nozzle opening 21 and ink droplets are ejected from nozzle openings 21 on both sides at the same time, pressure is applied to the sectioning wall between the adjacent communication paths 16 from both sides. In such a case, the sectioning wall is not easily deformed due to the pressure applied from both sides, regardless of the rigidity of the sectioning wall. In contrast, in a case where ink droplets are not ejected from the nozzle openings 21 on both sides of the nozzle opening 21 that ejects ink droplets, pressure is applied to one side of the sectioning wall between the adjacent communication paths 16. If the rigidity of the sectioning wall is low at this time, the sectioning wall is deformed, variations in pressure are absorbed, and ink droplet ejecting properties are degraded. Therefore, the ink droplet ejecting properties vary depending on a difference in conditions related to which of the plurality of nozzle openings 21 the ink droplets are to be ejected. According to the embodiment, it is possible to enhance the rigidity of the sectioning wall between the adjacent communication paths 16 and to thereby make it difficult to deform the sectioning wall even in a case where the pressure is applied to the sectioning wall from one side. Accordingly, it is possible to suppress the variations in the ejecting properties by reducing the difference in the amount of deformation of the sectioning wall both in the case where the pressure is applied to the sectioning wall from one side and in the case where the pressure is applied thereto from both sides.

According to the embodiment, the first pressure generation chamber 12A and the second pressure generation chamber 12B are provided to have the same length in the second direction Y at the same position in the second direction Y. Therefore, it is possible to suppress variations in the ejecting properties between the ink droplets ejected from the first nozzle opening 21A and the ink droplets ejected from the second nozzle opening 21B. Incidentally, displacement properties easily vary due to positional deviation of an electrode of a piezoelectric actuator 300 provided for each pressure generation chamber 12 and the ink droplet ejecting properties vary in the case where the lengths of the first pressure generation chamber 12A and the second pressure generation chamber 12B in the second direction Y are changed and the first pressure generation chamber 12A and the second pressure generation chamber 12B are arranged at mutually different positions in the second direction Y. Specifically, it is also necessary to arrange supply communication paths 19 that establishes communication between the manifold 100 and the pressure generation chambers 12 at different positions in the second direction Y in accordance with the first pressure generation chamber 12A and the second pressure generation chamber 12B in the case where the first pressure generation chamber 12A and the second pressure generation chamber 12B are arranged at different positions in the second direction Y. Therefore, there is a concern that the changing of the positions of the supply communication paths 19 makes it difficult to precisely form the supply communication paths 19 and the manifold 100 and the shapes varies. If the shapes of the supply communication paths 19 and the manifold 100 vary as described above, inertance and the like that affect properties of ink supply and ink droplet ejection to the pressure generation chambers 12 vary, the ink ejecting properties thus vary. According to the embodiment, it is possible to arrange the supply communication paths 19 that communicate with the first pressure generation chamber 12A and the second pressure generation chamber 12B at the same positions in the second direction Y, to precisely form the supply communication paths 19 and the manifold 100 with less variations, and to thereby suppress variations in the ink droplet ejecting properties, by arranging the first pressure generation chamber 12A and the second pressure generation chamber 12B to have the same length in the second direction Y at the same position in the second direction Y.

According to the embodiment, the communication paths 16 are arranged such that one of an inlet and an outlet of each communication path 16 is arranged inside the other in a plan view from the third direction Z. That is, the inlet, which opens in each pressure generation chamber 12, of each communication path 16 and the outlet communicating with each nozzle opening 21 are in an inclusive relationship, in which one of the inlet and the outlet is included in the other, in a plan view from the third direction Z. Since the oblique portions are provided on the side of the pressure generation chambers 12 in the embodiment, the opening area of the inlets is greater than that of the outlets. Therefore, the outlets are arranged at such positions to be included inside the inlets in a plan view from the third direction Z. It is possible to precisely form the communication paths 16 on the communication plate 15 as will be described later in detail and to suppress the variations in the ink ejecting properties due to the variations in shapes by configuring the communication paths 16 as described above.

According to the embodiment, it is possible to arrange the adjacent first nozzle opening 21A and the second nozzle opening 21B at further positions with low density by providing the first nozzle opening 21A and the second nozzle opening 21B at different positions in the second direction Y. In doing so, it is possible to suppress deviations in landing positions due to influences of the ink droplets ejected from the mutually adjacent nozzle openings 21 and to enhance the printing quality. Incidentally, if the adjacent nozzle openings 21 are arranged at closer positions with high density so-called wind patterns are formed since the ejected ink droplets roll up wind and causes deviations in landing positions of the ink droplets. According to the embodiment, it is possible to suppress the wind patterns.

Furthermore, it is possible to establish communication with an end of the second pressure generation chamber 12B on the side of Y1 and the second communication path 16B by providing the second oblique portion 161B in the second communication path 16B on the side of Y1 in the second direction Y. Therefore, it is possible to suppress formation of a portion where an ink flow accumulated on the side of Y1 of the second pressure generation chamber 12B, to enhance air bubble discharging properties when the air bubbles included in the ink are discharged from the nozzle openings 21. And to suppress ejection failures due to remaining air bubbles. Incidentally, the first oblique portion 161A is provided in the first communication path 16A on the side of Y2 in the second direction Y. However, since the first linear portion 162A is provided at such a position that the first linear portion 162A faces an end of the first pressure generation chamber 12A on the side of Y1 in the third direction Z, the end of the first pressure generation chamber 12A on the side of Y1 communicates with the first oblique portion 161A. Therefore, it is also possible to suppress the accumulation of the ink in the first pressure generation chamber 12A.

Such a communication plate 15 is provided with a first manifold portion 17 and a second manifold portion 18 that form a part of the manifold 100. That is, the communication plate 15 according to the embodiment is a manifold substrate provided with the manifold.

The first manifold portion 17 is provided so as to penetrate through the communication plate 15 in the third direction Z.

The second manifold portion 18 is provided so as to be opened in the communication plate 15 on the side of the nozzle plate 20 without penetrating through the communication plate 15 in the third direction Z.

Furthermore, each supply communication path 19 communicating with one end of each pressure generation chamber 12 in the second direction Y is provided on the communication plate 15 independently from each pressure generation chamber 12. The supply communication paths 19 establishes communication between the second manifold portion 18 and the pressure generation chambers 12. That is, the supply communication paths 19 are aligned in the first direction X with respect to the manifold 100. Since the first pressure generation chamber 12A and the second pressure generation chamber 12B are arranged at the same positions in the second direction Y in the embodiment, it is possible to arrange the supply communication paths 19, which are aligned in the first direction X, at the same position in the second direction Y. That is, it is possible to arrange the supply communication path 19 (also referred to as a first supply communication path) that establishes communication between the first pressure generation chamber 12A and the manifold 100 and the supply communication path 19 (also referred to as a second supply communication path that establishes communication between the second pressure generation chamber 12B and the manifold 100 at the same position in the second direction Y). Therefore, it is possible to suppress variations in processing precision when the first manifold portion 17, the second manifold portion 18, and the supply communication path 19 are formed in the communication plate 15 by anisotropic etching, to precisely form the first manifold portion 17, the second manifold portion 18, and the supply communication path 19, and thereby to suppress variations in the ink droplet ejecting properties. Incidentally, in a case where adjacent supply communication paths 19 are formed at different positions in the second direction Y, sagging is partially formed in the bottom surface of the second manifold portion 18, variations occur in the processing precision, and variations in the ink droplet ejecting properties increase depending on the positions of the supply communication paths 19 with respect to the second manifold portion 18. Since the plurality of supply communication paths 19 are arranged at the same position in the second direction Y with respect to the second manifold portion 18 in the embodiment, it is possible to suppress partial sagging during the etching and to thereby reduce the variations in the ink droplet ejecting properties.

Here, description will be given of a method of manufacturing such a communication plate 15, particularly, a method of manufacturing the communication paths 16 with reference to FIGS. 6 to 10. FIGS. 6 to 10 are sectional views illustrating the method of manufacturing the communication plate.

Figure 6:
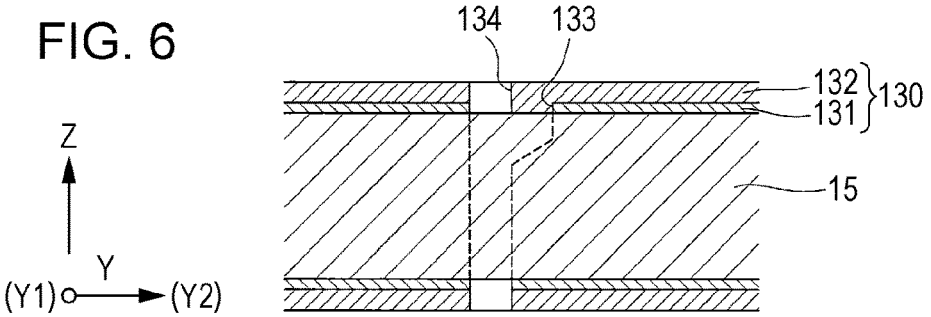
FIG. 6 is a sectional view illustrating a method of manufacturing the recording head according to the first embodiment of the invention.

As illustrated in FIG. 6, a mask 130 is formed on each of both surfaces of the communication plate 15 made of a silicon single-crystal substrate. The mask 130 is formed by laminating a first mask 131 for forming the oblique portion 161 in a later process and a second mask 132 for forming the linear portion 162. A first opening 133 for forming the oblique portion 161 is formed in advance in the first mask 131. A second opening 134 that penetrates in the third direction Z for forming the linear portion 162 is formed in the first mask 131 and the second mask 132.

Figure 7:
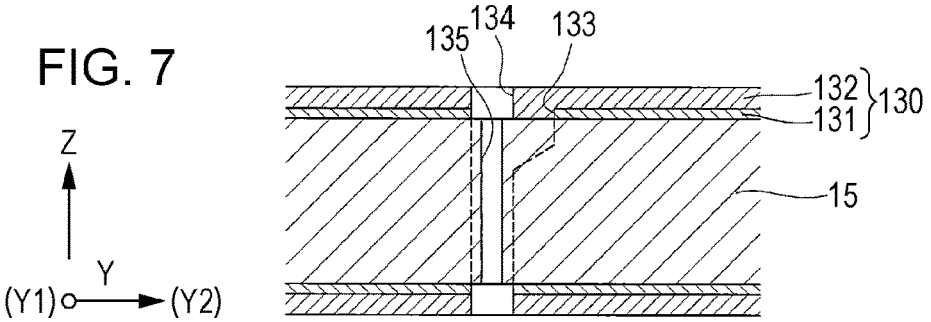
FIG. 7 is a sectional view illustrating the method of manufacturing the recording head according to the first embodiment of the invention.

Then, a first through-hole 135 that penetrates through the communication plate 15 in the third direction Z is formed at a position, which corresponds to the second opening 134, in the communication plate 15 as illustrated in FIG. 7. The first through-hole 135 can be formed by laser processing or dry etching, for example.

Figure 8:
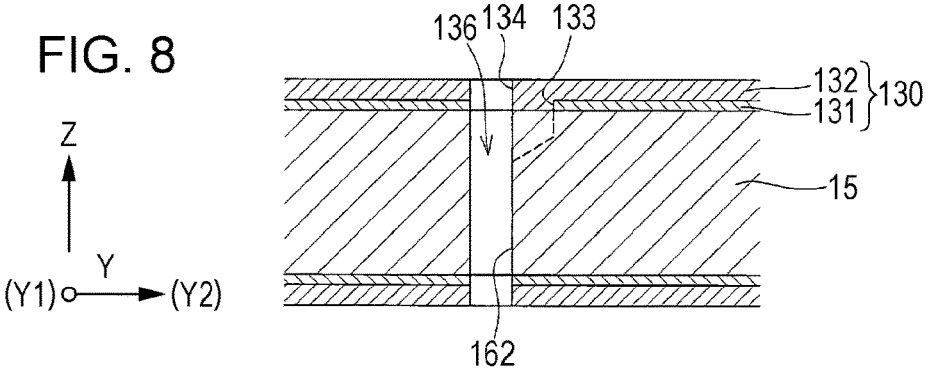
FIG. 8 is a sectional view illustrating the method of manufacturing the recording head according to the first embodiment of the invention.

Next, the inner surface of the first through-hole 135 is smoothed by performing anisotropic etching using an alkali solution, such as KOH, on the communication plate 15 from the second opening 134, and a second through-hole 136 including the linear portion 162 is formed as illustrated in FIG. 8. According to the embodiment, it is possible to further precisely form the through-hole with a relatively small opening area in the relatively thick communication plate 15 by the anisotropic etching by forming the second through-hole 136 by the anisotropic etching after forming the first through-hole 135 by laser processing or dry etching.

Figure 9:
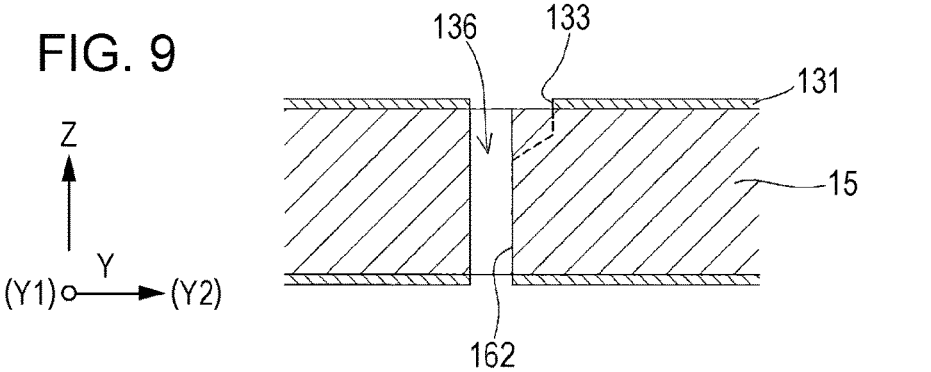
FIG. 9 is a sectional view illustrating a method of manufacturing the recording head according to the first embodiment of the invention.

Next, the second mask 132 is removed as illustrated in FIG. 9. In doing so, only the first mask 131 from which the first opening 133 is opened is formed on the communication plate 15.

Figure 10:
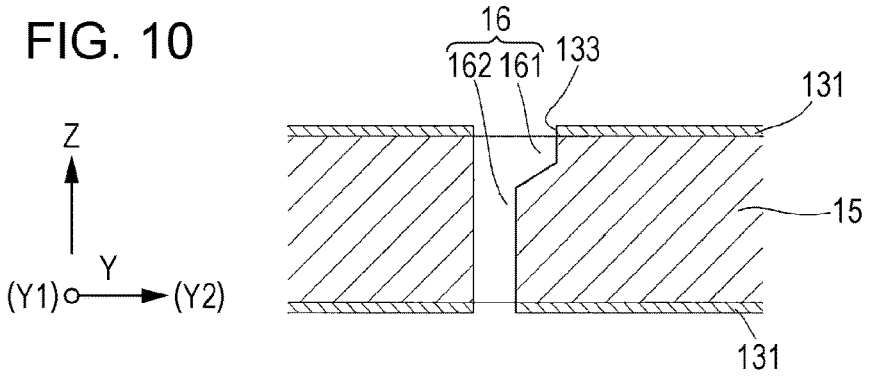
FIG. 10 is a sectional view illustrating the method of manufacturing the recording head according to the first embodiment of the invention.

Next, the oblique portion 161 is formed by performing anisotropic etching using an alkali solution on the communication plate 15 from the first opening 133 as illustrated in FIG. 10. In doing so, a portion other than the oblique portion 161 becomes the linear portion 162, and the communication path 16 including the oblique portion 161 and the linear portion 162 can be obtained. The depth of the oblique portion 161 in the third direction Z can be adjusted by etching time.

It is possible to more easily and precisely from the oblique portion 161 as compared with a case of forming the oblique portion at an intermediate portion in the third direction Z, by forming the oblique portion 161 on one surface of the communication plate 15 in the third direction Z. That is, it is possible to precisely form the communication path 16, to enhance the shape stability of the communication path 16, to suppress variations in the ink ejecting properties due to variations in the shape of the communication path 16, and to enhance the printing quality.

Description will be given of a manufacturing method in a case of forming the oblique portion in the course of the communication path in the third direction Z as a comparative example with respect to such a communication path 16 according to the embodiment, with reference to FIGS. 11 to 16.

Figure 11:
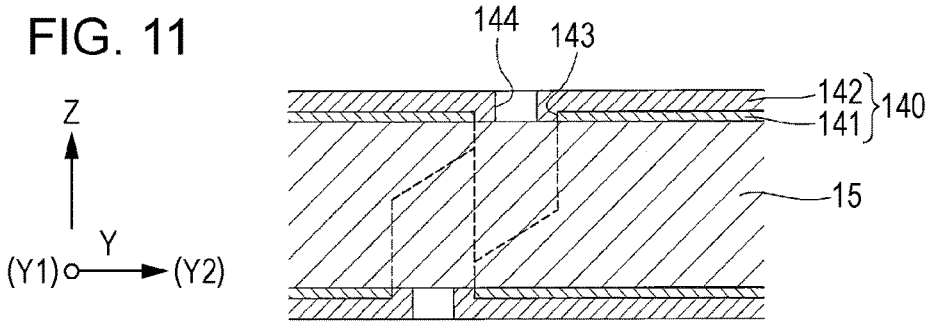
FIG. 11 is a sectional view illustrating a manufacturing method according to a comparative example of the first embodiment of the invention.

As illustrated in FIG. 11, a mask 140 is formed on each of both sides of the communication plate 15 made of a silicon single-crystal substrate. The mask 140 is formed by laminating a third mask 141 and a fourth mask 142, the third mask 141 is provided with a third opening 143, and the third mask 141 and the fourth mask 142 are provided with a fourth opening 144 penetrating therethrough in the thickness direction.

Figure 12:
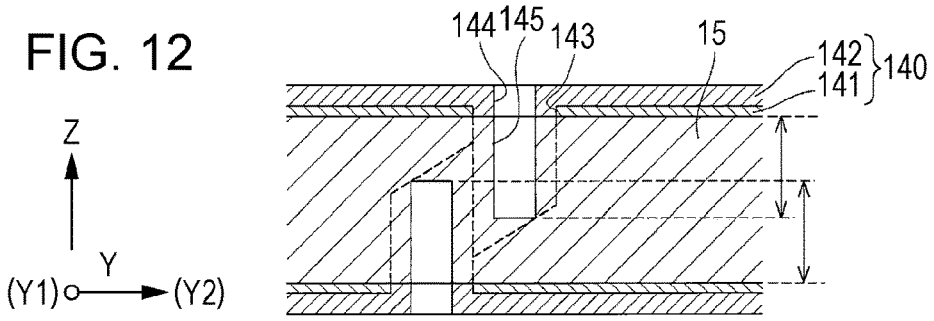
FIG. 12 is a sectional view illustrating the manufacturing method according to the comparative example of the first embodiment of the invention.

Next, recessed portions 145 are formed by laser processing or dry etching the communication plate 15 from the fourth opening 144 as illustrated in FIG. 12. The recessed portions 145 are formed so as not to penetrate through the communication plate 15 in the third direction Z. Incidentally, it is also possible to form the recessed portions 145 by anisotropic etching. However, it is difficult to form the deep recessed portions 145 with small opening areas by the anisotropic etching. Therefore, the recessed portions 145 with relatively small opening areas are formed by laser processing or dry etching. However, the laser etching or the dry etching easily causes variations in the depths of the recessed portions 145.

Figure 13:
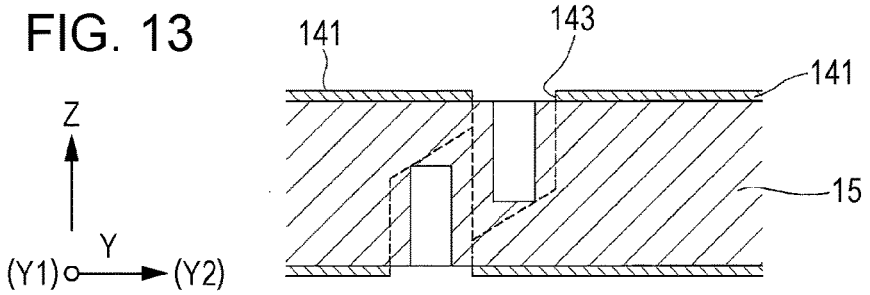
FIG. 13 is a sectional view illustrating the manufacturing method according to the comparative example of the first embodiment of the invention.

Next, the third opening 143 of the third mask 141 is exposed by removing the fourth mask 142 as illustrated in FIG. 13.

Figure 14:
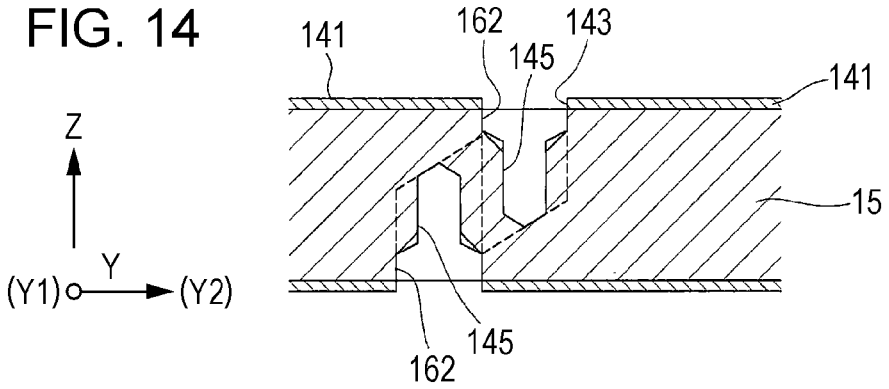
FIG. 14 is a sectional view illustrating the manufacturing method according to the comparative example of the first embodiment of the invention.
Figure 15:
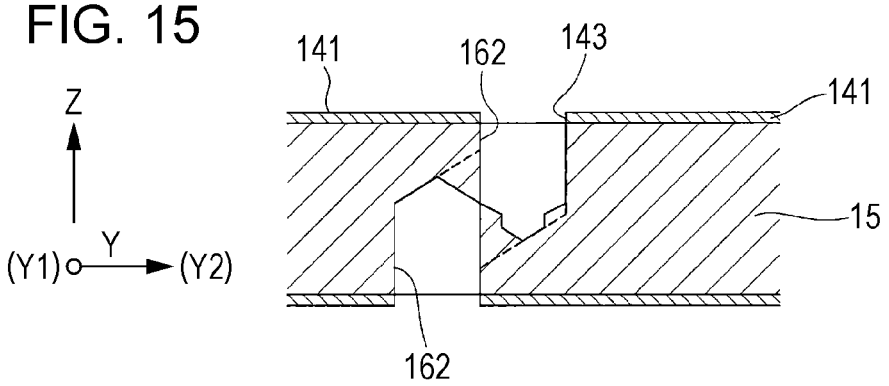
FIG. 15 is a sectional view illustrating the manufacturing method according to the comparative example of the first embodiment of the invention.
Figure 16:
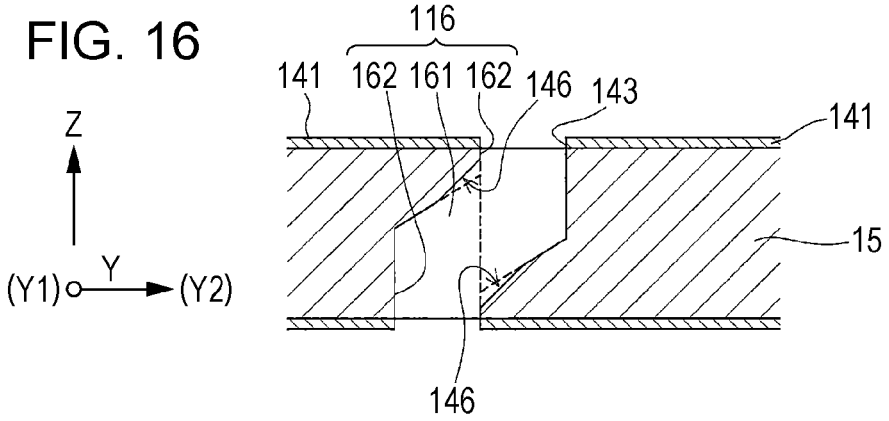
FIG. 16 is a sectional view illustrating the manufacturing method according to the comparative example of the first embodiment of the invention.

Next, sectioning walls of the recessed portions 145 are etched by performing anisotropic etching using an alkali solution on the communication plate 15 from the third opening 143, and recessed portions 145 provided on both sides in the third direction Z are made to communicate with each other by increasing the widths of the recessed portions 145 as illustrated in FIGS. 14 to 16. In doing so, linear portions 162 are formed on both surface sides in the third direction Z, and a communication path 116 with an oblique portion 161 formed between the two linear portions 162 in the third direction Z is formed. However, a wall of a communicating portion is etched from both sides when the two recessed portions 145 are made to communicate with each other as illustrated in FIG. 15, and sagging 146 due to the etching is formed at the connecting portion between the oblique portion 161 and the linear portions 162 as illustrated in FIG. 16. Such sagging 146 causes variations in the ink ejecting properties due to low processing precision and variations in shapes.

That is, an inlet of the communication path 116 illustrated in FIG. 16 on the side of the pressure generation chamber 12 and an outlet thereof on the side of the nozzle opening 21 are not positioned such that one of the inlet and the outlet is included in the other in projection in the third direction Z. With such a configuration, it is necessary to couple the two linear portions 162 with the oblique portion 161, and sagging 146 due to the etching occurs. The communication path 16 according to the embodiment is configured such that one of the inlet on the side of the pressure generation chamber 12 and the outlet on the side of the nozzle opening 21 is included in the other in projection in the third direction Z. That is, the oblique portion 161 is provided so as to be opened in one surface of the communication plate 15 in the third direction Z. Therefore, sagging 146 due to the etching is not easily generated at the connecting portion between the oblique portion 161 and the linear portion 162, and it is possible to precisely form the communication path 16.

In contrast, a diaphragm 50 is formed on the flow path forming substrate 10 on an opposite surface side of the communication plate 15 as illustrated in FIGS. 2 to 4. According to the embodiment, an elastic film 51 that is provided on the side of the flow path forming substrate 10 and is made of silicon oxide and an insulating film 52 that is provided on the elastic film 51 and is made of zirconium oxide are provided as the diaphragm 50.

A piezoelectric actuator 300 including a first electrode 60, a piezoelectric element layer 70, and a second electrode 80 is provided on the diaphragm 50 on the flow path forming substrate 10. Here, according to the embodiment, the first electrode 60 is cut and split for each pressure generation chamber 12 and forms an individual electrode that is independent for each active portion as will be described later in detail.

The piezoelectric element layer 70 is successively provided in the first direction X so as to have a predetermined width in the second direction Y. It is a matter of course that the piezoelectric element layer 70 may be cut and split for each pressure generation chamber 12.

An end of the supply communication path 19 on the side of the piezoelectric element layer 70 is positioned further outside beyond an end of the first electrode 60 in the pressure generation chamber 12 in the second direction Y. That is, the end of the first electrode 60 is covered with the piezoelectric element layer 70. An end of the piezoelectric element layer 70 on the side of the nozzle opening 21 is positioned further inside (on the side of the pressure generation chamber 12) beyond an end of the first electrode 60, and the end of the first electrode 60 on the side of the nozzle opening 21 is not covered with the piezoelectric element layer 70. A lead electrode 90 is connected to the first electrode 60 exposed from the piezoelectric element layer 70 as described above.

The piezoelectric element layer 70 is made of a piezoelectric material of an oxidative product that is formed on the first electrode 60 and has a polarization structure, and can be made of a perovskite oxidative product represented by a formula $ABO_3$, for example, and a lead-based piezoelectric material containing lead or a non-lead-based piezoelectric material containing no lead can be used.

The second electrode 80 is provided on the piezoelectric element layer 70 on the opposite surface side of the first electrode 60 and forms a common electrode shared by a plurality of active portions.

The piezoelectric actuator 300 formed of the first electrode 60, the piezoelectric element layer 70, and the second electrode 80 as described above is displaced by a voltage applied between the first electrode 60 and the second electrode 80. That is, piezoelectric strain occurs in the piezoelectric element layer 70 interposed between the first electrode 60 and the second electrode 80 by the voltage applied between both the electrodes. In addition, portions, in which the piezoelectric strain occurs, of the piezoelectric element layer 70 will be referred to as active portions. In contrast, portions, in which no piezoelectric strain occurs, of the piezoelectric element layer 70 will be referred to as non-active portions.

The lead electrode 90 is drawn from each of the first electrode 60 and the second electrode 80 of the piezoelectric actuator 300, and a flexible cable 120 is connected to the drawn lead electrode 90.

The flexible cable 120 is a wiring substrate with flexibility, and a drive circuit 121 that is a semiconductor element is mounted in the embodiment.

A protective substrate 30 with substantially the same size as that of the flow path forming substrate 10 is joined to a surface of such a flow path forming substrate 10 on the side of the piezoelectric actuator 300. The protective substrate 30 includes holding portions 31 as spaces for protecting the piezoelectric actuator 300. Two holding portions 31 are aligned in the second direction Y between arrays of piezoelectric actuators 300 aligned in the first direction X. A through-hole 32 penetrating in the third direction Z is provided in the protective substrate 30 between the two holding portions 31 aligned in the second direction Y. An end of the lead electrode 90 drawn from each electrode of the piezoelectric actuator 300 extends so as to be exposed to the inside of the through-hole 32, and the lead electrode 90 and a wiring, which is not shown in the drawing, of the flexible cable 120 are electrically connected to each other in the through-hole 32.

A case member 40 that defines the manifold 100 communicating with the plurality of pressure generation chambers 12 along with the flow path forming substrate 10 is fixed to the protective substrate 30. The case member 40 has substantially the same shape as that of the aforementioned communication plate 15 in a plan view, is joined to the protective substrate 30, and is also joined to the aforementioned communication plate 15. Specifically, the case member 40 includes, on the side of the protective substrate 30, a recessed portion 41 with such a depth that the flow path forming substrate 10 and the protective substrate 30 are accommodated therein. The recessed portion 41 has a larger opening area than the area of the surface, which is joined to the flow path forming substrate 10, of the protective substrate 30. The opening surface of the recessed portion 41 on the side of the nozzle plate 20 is sealed with the communication plate 15 in a state where the flow path forming substrate 10 and the like are accommodated in the recessed portion 41. In doing so, a third manifold portion 42 is defined by the case member 40 and the flow path forming substrate 10 in an outer circumference of the flow path forming substrate 10. The first manifold portion 17 and the second manifold portion 18 provided on the communication plate 15 and the third manifold portion 42 defined by the case member 40 and the flow path forming substrate 10 form the manifold 100 according to the embodiment. The manifold 100 is successively provided in the first direction X that is an alignment direction of the pressure generation chambers 12, and the supply communication paths 19 that establishes communication between the respective pressure generation chambers 12 and the manifold 100 are aligned in the first direction X.

A compliance substrate 45 is provided on a surface, in which the first manifold portion 17 and the second manifold portion 18 are opened, of the communication plate 15. The compliance substrate 45 seals the openings of the first manifold portion 17 and the second manifold portion 18 on a side of a liquid ejecting surface 20*a*. Such a compliance substrate 45 includes a sealing film 46 made of a thin film with flexibility and a fixed substrate 47 made of a hard material such as metal. Since a region, which faces the manifold 100, of the fixed substrate 47 corresponds to an opening 48 that is completely removed in the thickness direction, one surface of the manifold 100 forms a compliance portion 49 that is a flexible portion sealed only with the sealing film 46 with flexibility.

An introduction path 44 that communicates with the manifold 100 and supplies ink to the manifold 100 is provided in the case member 40. In addition, a connecting port 43, which communicates with the through-hole 32 of the protective substrate 30, into which the flexible cable 120 is inserted, is provided in the case member 40.

According to such a recording head 1, the ink is taken from the introduction path 44 for ejecting the ink, and the inside of a flow path from the manifold 100 to the nozzle openings 21 is filled with the ink. Thereafter, the piezoelectric actuators 300 and the diaphragm 50 are bent and deformed by applying a voltage to the respective piezoelectric actuators 300 corresponding to the pressure generation chambers 12 in response to a signal from the drive circuit 121. In doing so, pressure in the pressure generation chambers 12 increases, and ink droplets are ejected from the predetermined nozzle openings 21.

Second Embodiment

Figure 17:
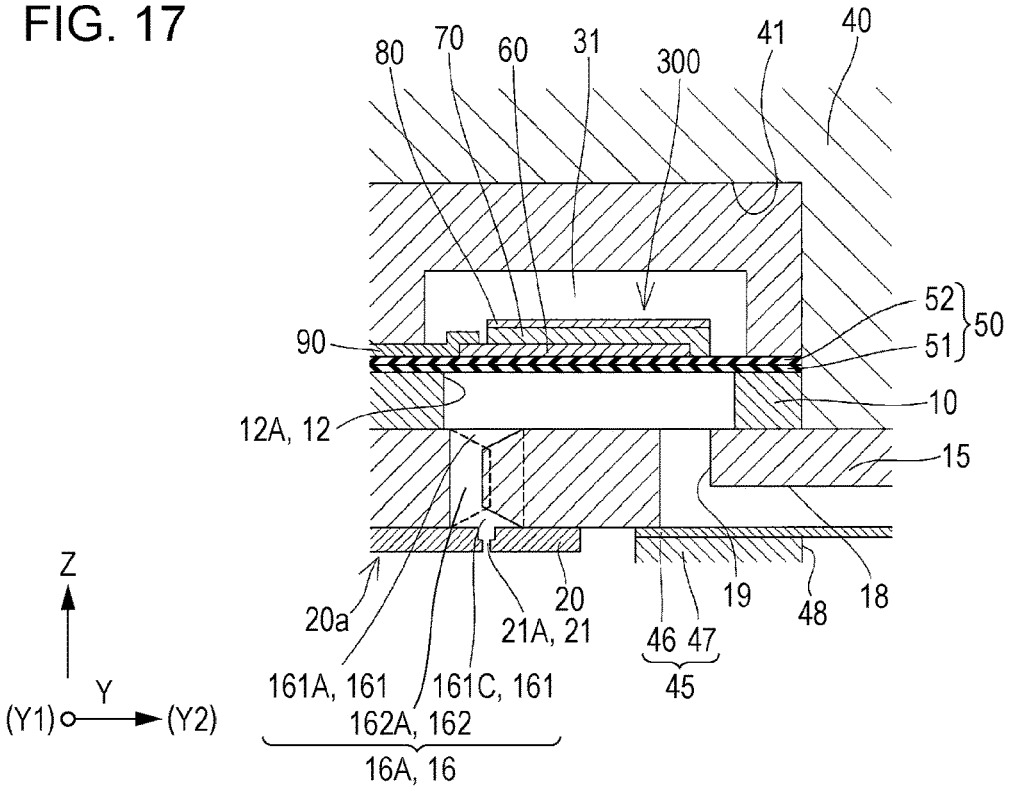
FIG. 17 is an enlarged sectional view of main parts of a recording head according to a second embodiment of the invention.
Figure 18:
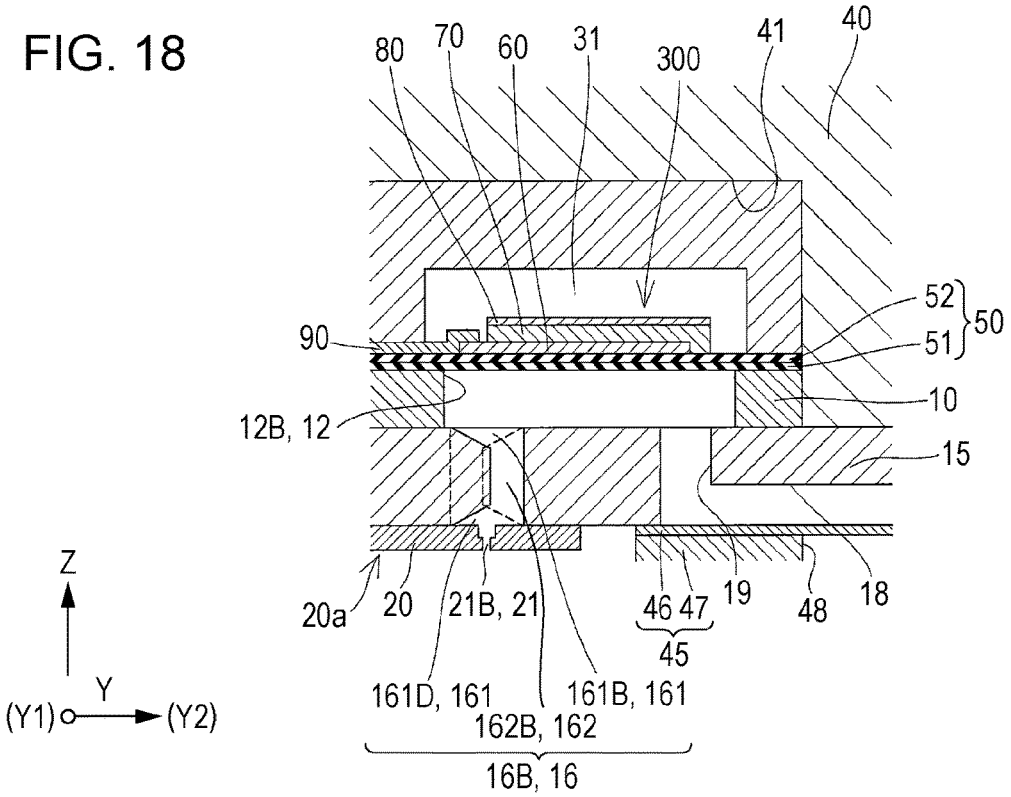
FIG. 18 is an enlarged sectional view of main parts of the recording head according to the second embodiment of the invention.

FIGS. 17 and 18 are enlarged sectional views of main parts of an ink jet recording head in an example of a liquid ejecting head according to a second embodiment of the invention. The same reference numerals will be given to the same members as those in the aforementioned embodiment, and repeated description will be omitted.

As illustrated in the drawings, a recording head 1 according to the embodiment includes a communication plate 15 including communication paths 16 that establish communication between pressure generation chambers 12 and nozzle openings 21.

The communication paths 16 on the communication plate 15 is formed of a first communication path 16A that establishes communication between a first pressure generation chamber 12A and a first nozzle opening 21A illustrated in FIG. 17 and a second communication path 16B that establishes communication between a second pressure generation chamber 12B and a second nozzle opening 21B illustrated in FIG. 18.

The first communication path 16A includes a first oblique portion 161A, a first linear portion 162A, and a third oblique portion 161C. The first oblique portion 161A, the first linear portion 162A, and the third oblique portion 161C are aligned in this order from the side of the first pressure generation chamber 12A toward the side of the first nozzle opening 21A in a third direction Z. The first oblique portion 161A is provided on a side of Y2 in a second direction Y. The third oblique portion 161C is provided on a side of Y2 in the second direction Y. The first linear portion 162A establishes communication between the first oblique portion 161A and the third oblique portion 161C. The first oblique portion 161A is provided on the side of Y2 in the same manner as in the aforementioned first embodiment. The third oblique portion 161C has a section area changing from the side of the first pressure generation chamber 12A toward the side of the first nozzle opening 21A, and in the embodiment, the section area is reduced from the side of the first pressure generation chamber 12A toward the first nozzle opening 21A. According to the embodiment, the third oblique portion 161C is formed by gradually increasing the width of an opening on the side of Y2 with respect to the first linear portion 162A toward the side of the nozzle opening 21 in the third direction Z. That is, the third oblique portion 161C is provided on the side of Y2 corresponding to one side in the second direction Y. Such a first communication path 16A is arranged such that one of an inlet on the side of the first pressure generation chamber 12A and an outlet on the side of the first nozzle opening 21A is included in the other in a plan view from the third direction Z. According to the embodiment, the opening of the first oblique portion 161A on the side of the first pressure generation chamber 12A and an opening of the third oblique portion 161C on the side of the first nozzle opening 21A are formed to have the same opening area such that the openings substantially coincide with each other in a plan view from the third direction Z.

In contrast, the second communication path 16B includes a second oblique portion 161B, a second linear portion 162B, and a fourth oblique portion 161D. The second oblique portion 161B, the second linear portion 162B, and the fourth oblique portion 161D are aligned in this order from the side of the second pressure generation chamber 12B toward the side of the second nozzle opening 21B in the third direction Z. The second oblique portion 161B is provided on the side of Y1 in the second direction Y. The fourth oblique portion 161D is provided on the side of Y1 in the second direction Y. Such a second communication path 16B is arranged such that one of an inlet communicating with the second pressure generation chamber 12B of the second communication path 16B and an outlet communicating with the second nozzle opening 21B is included in the other in a plan view from the third direction Z in the same manner as the first communication path 16A.

The first nozzle opening 21A and the second nozzle opening 21B with which the first communication path 16A and the second communication path 16B communicate, respectively, are arranged at the same position in the second direction Y. That is, the plurality of nozzle openings 21 are arranged on a straight line along the first direction X.

It is possible to suppress complete overlapping of the first communication path 16A and the second communication path 16B in the first direction X and to enhance rigidity of a sectioning wall between the first communication path 16A and the second communication path 16B by providing the first oblique portion 161A and the third oblique portion 161C in the first communication path 16A and providing the second oblique portion 161B and the fourth oblique portion 161D in the second communication path 16B as described above. Therefore, it is possible to suppress variations in ink ejecting properties due to crosstalk of the sectioning wall and to thereby enhance printing quality.

According to the embodiment, it is possible to precisely arrange the first oblique portion 161A, the first nozzle opening 21A, and the second nozzle opening 21B in the first communication path 16A without deviating positions thereon in the second direction Y.

According to the embodiment, it is possible to suppress variations ejecting properties of ink droplets ejected from the first nozzle opening 21A and ink droplets ejected from the second nozzle opening 21B since the first pressure generation chamber 12A and the second pressure generation chamber 12B are provide to have the same length in the second direction at the same position in the second direction Y.

Furthermore, each communication path 16 is arranged such that one of the inlet and the outlet is included in the other in a plan view from the third direction Z as described above. That is, since the first oblique portion 161A, the third oblique portion 161C, the second oblique portion 161B, and the fourth oblique portion 161D are provided so as to be opened in the surface of the communication plate 15, the communication path 16 can be easily and precisely formed by anisotropic etching.

Furthermore, it is possible to establish communication between an end of the second pressure generation chamber 12B on the side of Y1 and the second communication path 16B by providing the second oblique portion 161B in the second communication path 16B on the side of Y1 in the second direction Y. Therefore, it is possible to suppress formation of a portion, in which an ink flow is accumulated, in the second pressure generation chamber 12B on the side of Y1, to enhance air bubble discharging properties when air bubbles included in ink are discharged from the nozzle openings 21, and to suppress ejection failures or the like due to remaining air bubbles.

Third Embodiment

Figure 19:
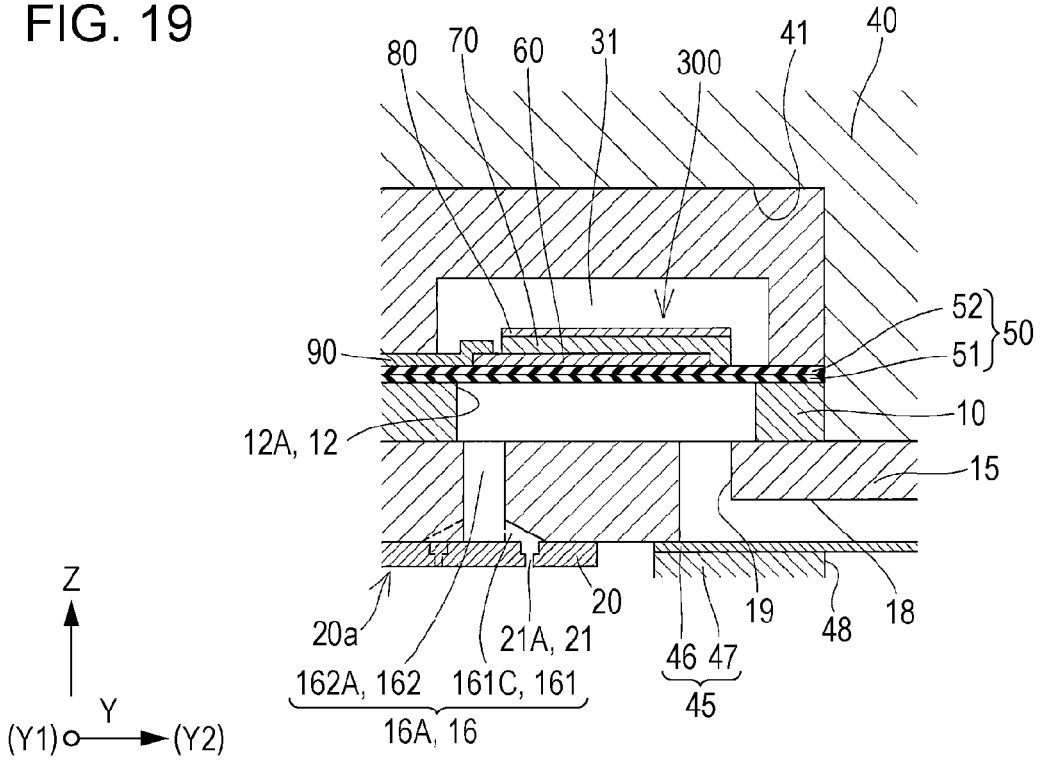
FIG. 19 is an enlarged sectional view of main parts of a recording head according to a third embodiment of the invention.
Figure 20:
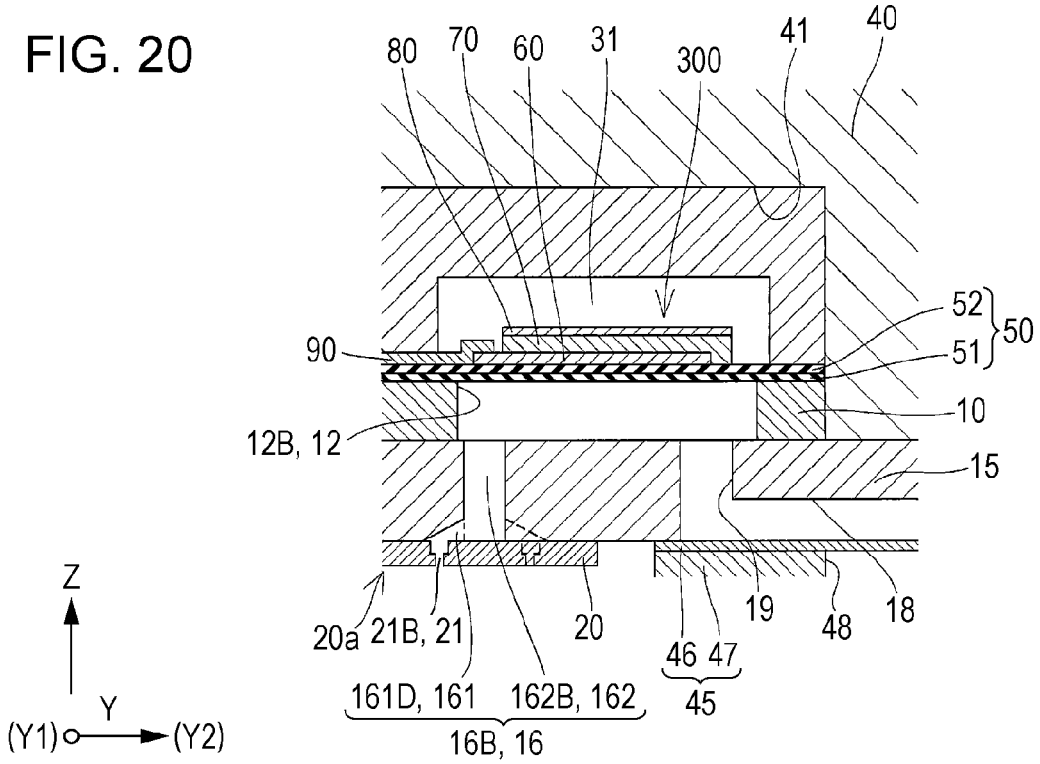
FIG. 20 is an enlarged sectional view of main parts of the recording head according to the third embodiment of the invention.

FIGS. 19 and 20 are sectional views of main parts of an ink jet recording head in one example of a liquid ejecting head according to a third embodiment of the invention. The same reference numerals will be given to the same members as those in the aforementioned embodiments, and repeated description will be omitted.

As illustrated in the drawings, a recording head 1 according to the embodiment includes a communication plate 15 including communication paths 16 that establish communication between pressure generation chambers 12 and nozzle openings 21.

The communication paths 16 on the communication plate 15 is classified into a first communication path 16A that establishes communication between a first pressure generation chamber 12A and a first nozzle opening 21A illustrated in FIG. 19 and a second communication path 16B that establishes communication between a second pressure generation chamber 12B and a second nozzle opening 21B illustrated in FIG. 20.

The first communication path 16A includes a first linear portion 162A and a third oblique portion 161C. That is, the first communication path 16A is not provided with the first oblique portion 161A according to the aforementioned first and second embodiments, and the first linear portion 162A and the first pressure generation chamber 12A are directly connected to each other. The first communication path 16A is provided such that an outlet is at such a position to be included in an inlet in a plan view from a third direction Z.

The second communication path 16B includes a second linear portion 162B and a fourth oblique portion 161D. The second communication path 16B is also provided such that an outlet is at such a position to be included in an inlet in a plan view from the third direction Z in the same manner.

The first nozzle opening 21A that communicates with the first communication path 16A and the second nozzle opening 21B that communicates with the second communication paths 16B as described above are provided at different positions in the second direction Y in the same manner as in the aforementioned first embodiment. According to the embodiment, it is possible to establish communication between the first nozzle opening 21A and the second nozzle opening 21B provided at different positions in the second direction Y and the first pressure generation chamber 12A and the second pressure generation chamber 12B provided at the same position in the second direction Y by providing the third oblique portion 161C in the first communication path 16A and providing the fourth oblique portion 161D in the second communication path 16B. It is possible to suppress variations in ejecting properties of ink droplets ejected from the first nozzle opening 21A and ink droplets ejected from the second nozzle opening 21B by providing the first pressure generation chamber 12A and the second pressure generation chamber 12B to have the same length in the second direction Y at the same position in the second direction Y as described above.

According to the embodiment, it is possible to arrange the adjacent first nozzle opening 21A and the second nozzle opening 21B at further positions with low density by providing the first nozzle opening 21A and the second nozzle opening 21B at different positions in the second direction Y. In doing so, it is possible to suppress deviations in landing positions due to influences of ink droplets ejected from the mutually adjacent nozzle openings 21 and to thereby enhance printing quality.

Furthermore, the first linear portion 162A and the second linear portion 162B are provided so as to communicate with ends of the pressure generation chambers 12 on the side of Y1, respectively, in the embodiment. Therefore, it is possible to suppress formation of portions, in which an ink flow is accumulated, at ends of the pressure generation chambers 12, to enhance air bubble discharging properties when air bubbles included in ink are discharged from the nozzle openings 21, and to suppress ejection failures due to remaining air bubbles. However, since the first linear portion 162A and the second linear portion 162B are provided at the same position in the second direction Y, rigidity of a sectioning wall between the adjacent communication paths 16 is lower than that in the first and second embodiments.

Fourth Embodiment

Figure 21:
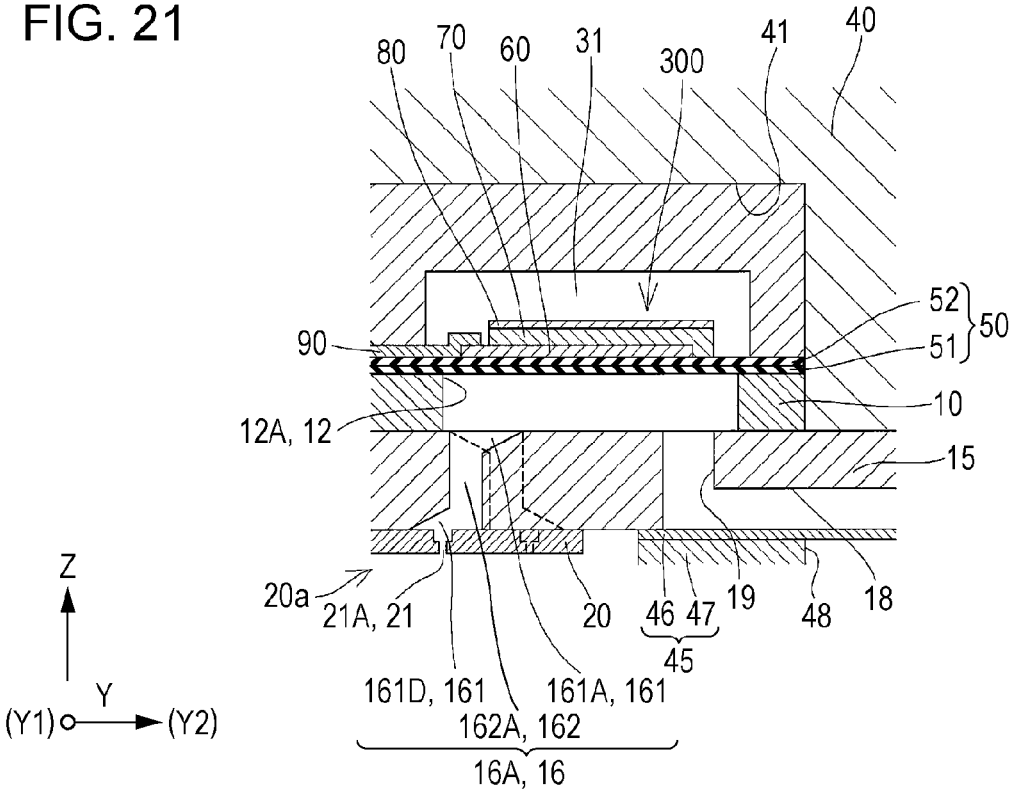
FIG. 21 is an enlarged sectional view of main parts of a recording head according to a fourth embodiment of the invention.
Figure 22:
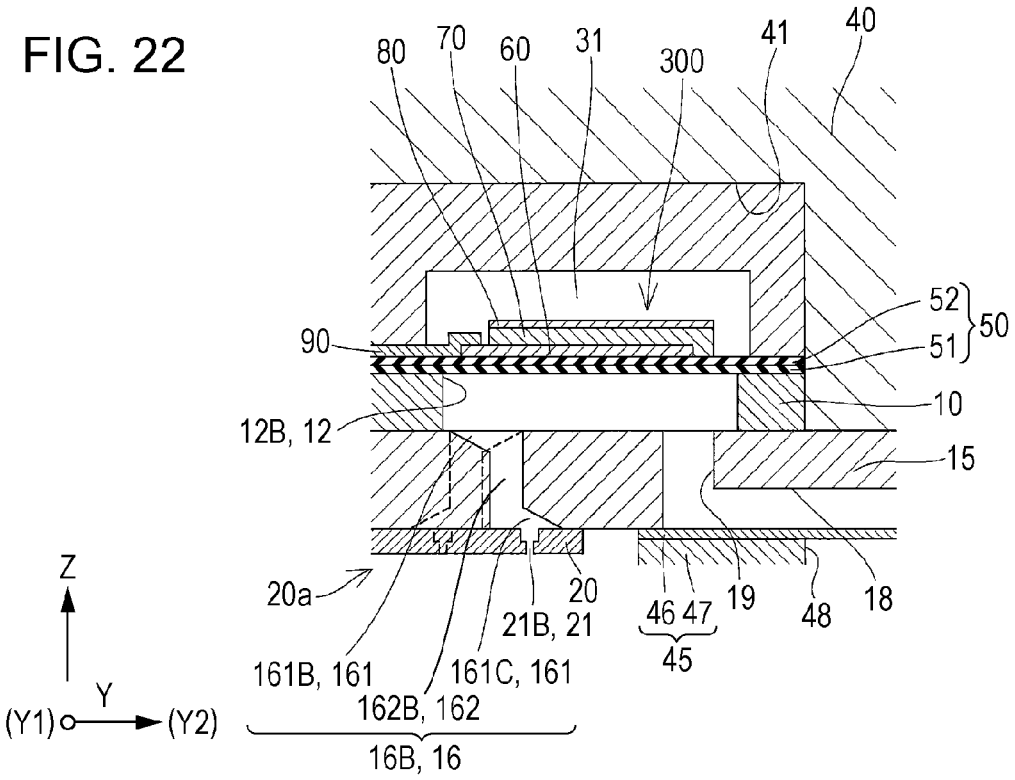
FIG. 22 is an enlarged sectional view of main parts of the recording head according to the fourth embodiment of the invention.

FIGS. 21 and 22 are sectional views of main parts of an ink jet recording head in one example of a liquid ejecting head according to a fourth embodiment of the invention. The same reference numerals will be given to the same members as those in the aforementioned embodiments, and repeated description will be omitted.

As illustrated in the drawings, a recording head 1 according to the embodiment includes a communication plate 15 including communication paths 16 that establish communication between pressure generation chambers 12 and nozzle openings 21.

The communication paths 16 are classified into a first communication path 16A that establishes communication between a first pressure generation chamber 12A and a first nozzle opening 21A illustrated in FIG. 21 and a second communication path 16B that establishes communication between a second pressure generation chamber 12B and a second nozzle opening 21B illustrated in FIG. 22.

The first communication path 16A includes a first oblique portion 161A, a first linear portion 162A, and a fourth oblique portion 161D.

The second communication path 16B includes a second oblique portion 161B, a second linear portion 162B, and a third oblique portion 161C.

That is, a configuration is employed in which the third oblique portion 161C of the first communication path 16A is replaced with the fourth oblique portion 161D of the second communication path 16B in the aforementioned second embodiment.

With such a configuration, the adjacent communication paths 16 do not completely overlap with each other in the first direction X, and it is possible to enhance rigidity of a sectioning wall between the communication paths 16, to reduce cross talk, and to suppress variations in ink ejecting properties.

The communication paths 16 can separate inlets communicating with the pressure generation chambers 12 from outlets communicating with the nozzle openings 21. Therefore, it is possible to further elongate the length between the first nozzle opening 21A and the second nozzle opening 21B as compared with that in the first embodiment. In doing so, it is possible to further effectively suppress formation of wind patterns.

Each of the first communication path 16A and the second communication path 16B according to the embodiment has a configuration in which one of an inlet and an outlet is not completely included in the other and a part thereof sticks out to the outside in a plan view from a third direction Z. However, since each oblique portion 161 is opened from both surfaces of the communication plate 15 in the third direction Z, it is possible to precisely form the oblique portion 161 by anisotropic etching. Therefore, it is possible to enhance shape stability of the communication paths 16, to suppress variations in ink ejecting properties due to variations in shapes of the communication paths 16, and to thereby enhance printing quality even with such a configuration.

According to the embodiment, it is possible to suppress variations in ejecting properties of ink droplets ejected from the first nozzle opening 21A and ink droplets ejected from the second nozzle opening 21B since the first pressure generation chamber 12A and the second pressure generation chamber 12B are provided to have the same length in the second direction Y at the same position in the second direction Y.

Other Embodiments

Although the respective embodiments of the invention were described hitherto, a basic configuration of the invention is not limited to the aforementioned configurations.

Figure 23:
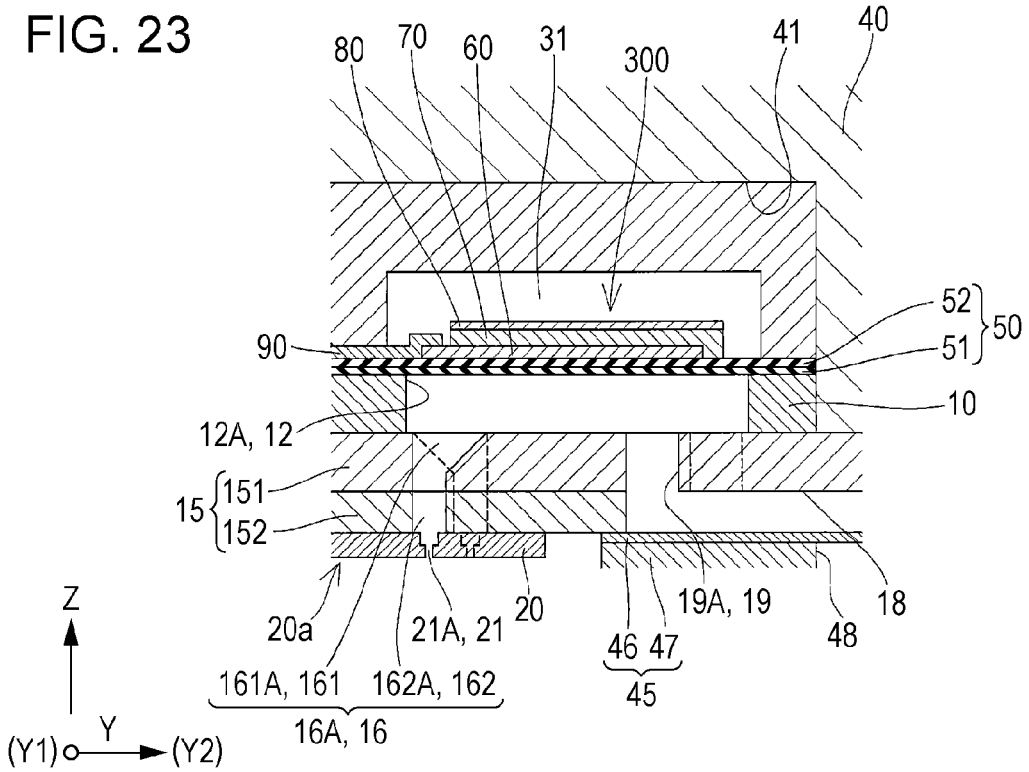
FIG. 23 is an enlarged sectional view of main parts of a recording head according to another embodiment of the invention.
Figure 24:
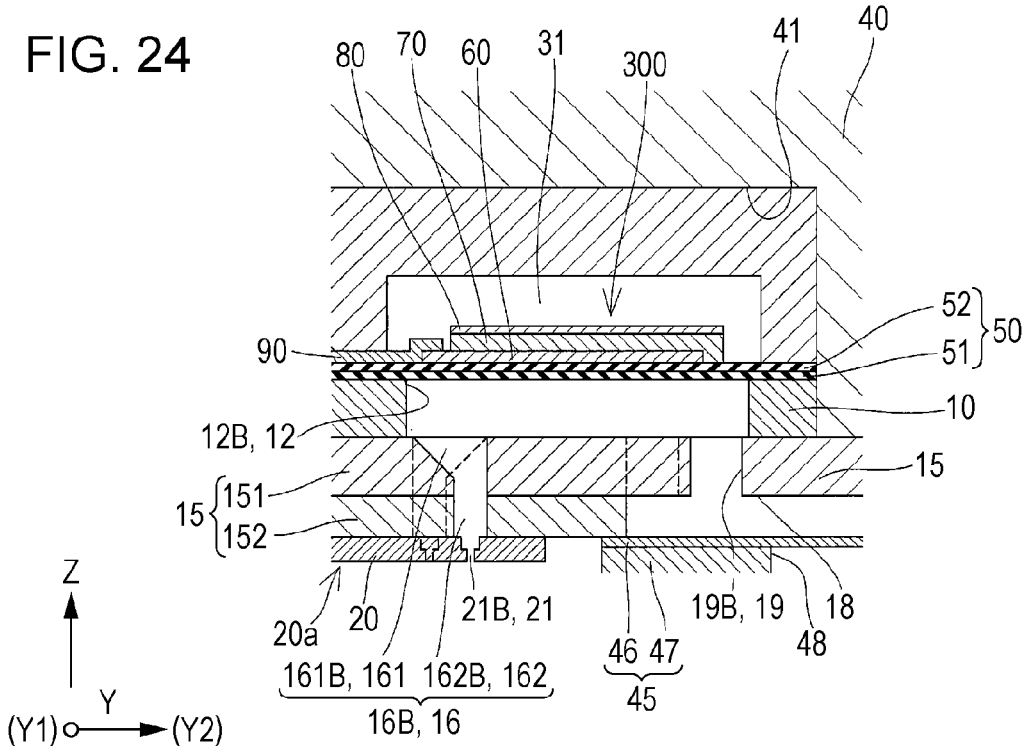
FIG. 24 is an enlarged sectional view of main parts of the recording head according to another embodiment of the invention.

For example, although the supply communication path 19 that establishes communication between the first pressure generation chamber 12A and the manifold 100 and the supply communication path 19 that establishes communication between the second pressure generation chamber 12B and the manifold 100 are arranged at the same position in the second direction Y in the aforementioned first to fourth embodiments, the invention is not particularly limited thereto. For example, the first supply communication path 19A and the second supply communication path 19B may be arranged at different positions in the second direction Y as illustrated in FIGS. 23 and 24. FIGS. 23 and 24 are sectional views of main parts of a recording head according to another embodiment of the invention.

As illustrated in FIGS. 23 and 24, the communication plate 15 includes a first communication plate 151 provided on a side of a flow path forming substrate 10 and a second communication plate 152 provided on a side of a nozzle plate 20.

In addition, the communication plate 15 is provided with supply communication paths 19. The supply communication paths 19 are classified into a first supply communication path 19A that establishes communication between a first pressure generation chamber 12A and a manifold 100 illustrated in FIG. 23 and a second supply communication path 19B that establishes communication between a second pressure generation chamber 12B and the manifold 100 illustrated in FIG. 24.

The first supply communication path 19A and the second supply communication path 19B are arranged at different positions in a second direction Y. In contrast, the first pressure generation chamber 12A and the second pressure generation chamber 12B are arranged at the same position in the second direction Y. That is, a clearance between the first supply communication path 19A and the second supply communication path 19B is wider than a clearance between the first pressure generation chamber 12A and the second pressure generation chamber 12B in the second direction Y. In addition, the clearance between the first supply communication path 19A and the second supply communication path 19B and the clearance between the first pressure generation chamber 12A and the second pressure generation chamber 12B represent intervals between the respective gravity centers.

The first supply communication path 19A and the second supply communication path 19B do not completely overlap with each other in the first direction X, and it is possible to enhance rigidity of a sectioning wall between the first supply communication path 19A and the second supply communication path 19B by arranging the first supply communication path 19A and the second supply communication path 19B at different positions in the second direction Y. Therefore, it is possible to suppress crosstalk of the sectioning wall between the first supply communication path 19A and the second supply communication path 19B, to suppress variations in ink droplet ejecting properties, and to thereby enhance printing quality.

The communication plate 15 is formed by laminating the first communication plate 151 and the second communication plate 152, the first supply communication path 19A and the second supply communication path 19B are formed in the first communication plate 151, and a second manifold portion 18 of the manifold 100 is formed in the second communication plate 152. That is, the first communication plate 151 functions as a communication plate, and the second communication plate 152 functions as a manifold substrate in which the manifold is formed. Therefore, it is possible to suppress sagging due to etching and to precisely form the first supply communication path 19A and the second supply communication path 19B even in a case where the first supply communication path 19A and the second supply communication path 19B communicate with the manifold 100 at different positions in the second direction Y. It is a matter of course that the first supply communication path 19A and the second supply communication path 19B of the supply communication paths 19 according to the aforementioned second to fourth embodiments may be located at different positions in the second direction Y.

Although each communication path 16 includes the oblique portion 161 and a linear portion 162 in the aforementioned first to fourth embodiments, the invention is not particularly limited thereto. For example, each communication path 16 may be formed only of the oblique portion 161.

Although the aforementioned first to fourth embodiments exemplified the configuration in which the flow path forming substrate 10 with the pressure generation chambers 12 formed therein and the communication plate 15 with the communication paths 16 formed therein were laminated, the invention is not particularly limited thereto. For example, a part or an entirety of the pressure generation chambers 12 may be formed in the communication plate 15. That is, the pressure chamber substrate with the pressure generation chambers 12 formed therein may be the flow path forming substrate 10, the communication plate 15, or both the flow path forming substrate 10 and the communication plate 15.

Furthermore, although a nozzle opening group formed of the nozzle openings 21 aligned in the first direction X ejects the same type of ink in the embodiment, the invention is not particularly limited thereto. For example, a single nozzle opening group may eject different types of ink. In such a case, the manifold 100 may be sectioned in the first direction X, for example.

Although the first pressure generation chamber 12A and the second pressure generation chamber 12B are arranged at the same position in the second direction Y in the aforementioned first to fourth embodiments, the invention is not particularly limited thereto. The first pressure generation chamber 12A and the second pressure generation chamber 12B may be arranged at different positions in the second direction Y.

Although the aforementioned respective embodiments exemplified a silicon single-crystal substrate as the communication plate 15, the invention is not particularly limited thereto. A material such as an SOI substrate or glass may be used.

Although the aforementioned respective embodiments were described in which the thin-film piezoelectric actuator 300 was used as a pressure generation mechanism that causes variations in pressure in the pressure generation chambers 12, the invention is not particularly limited thereto. For example, a thick-film piezoelectric actuator formed by a method of attaching a green sheet, a vertical variation-type piezoelectric actuator obtained by alternately laminating a piezoelectric material and an electrode forming material so as to extend and contract in an axial direction, or the like can be used. As the pressure generation mechanism, a mechanism, in which a heat generating element is arranged in a pressure generation chamber, which ejects liquid droplets from nozzle openings by bubbles generated by the heating of the heating element, a so-called electrostatic actuator which causes static electricity between a diaphragm and an electrode, deforms a diaphragms by the static electricity, and ejects liquid droplets from nozzle openings, or the like can be used.

Figure 25:
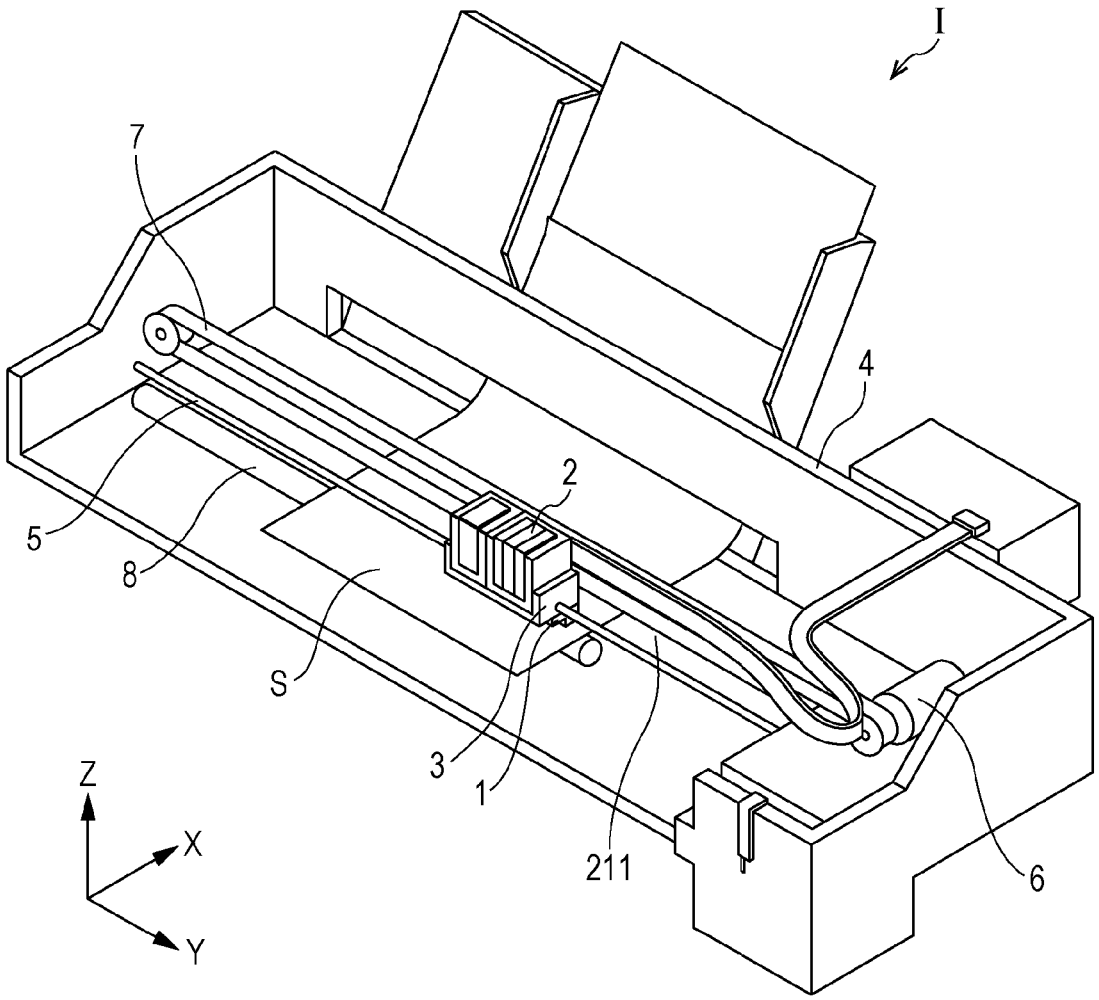
FIG. 25 is a diagram schematically illustrating a recording apparatus according to an embodiment of the invention.

The recording head 1 according to each embodiment is mounted on an ink jet recording apparatus. FIG. 25 is a diagram schematically illustrating an example of the ink jet recording apparatus.

In the ink jet recording apparatus I illustrated in FIG. 25, a plurality of ink jet recording heads 1 are mounted on a carriage 3. A cartridge 2 forming an ink supply mechanism is detachably provided on the carriage 3, and the carriage 3 with the recording heads 1 mounted thereon is provided at a carriage shaft 5 attached to an apparatus main body 4 so as to be movable in an axial direction. According to the embodiment, the recording heads 1 are mounted on the carriage 3 such that the second direction Y corresponds to a moving direction of the carriage 3.

The carriage 3 with the recording heads 1 mounted thereon is moved along the carriage shaft 5 by drive force of a drive motor 6 being delivered to the carriage 3 via a plurality of gears, which are not shown in the drawing, and a timing belt 7. In contrast, the apparatus main body 4 is provided with a transport roller 8 as a transport mechanism, and a recording sheet S as a recording medium such as paper is transported by the transport roller 8. The transport mechanism that transports the recording sheet S is not limited to the transport roller and may be a belt, a drum, or the like.

The aforementioned ink jet recording apparatus I was exemplified as the apparatus in which the recording heads 1 are mounted on the carriage 3 and move in a main scanning direction, the invention is not particularly limited thereto. For example, the invention can also be applied to a so-called line-type recording apparatus in which the recording heads 1 are fixed and printing is performed by only moving the recording sheet S such as paper in a sub scanning direction.

Furthermore, the aforementioned embodiments were described by exemplifying the ink jet recording head as an example of the liquid ejecting head. However, the invention is generally and widely directed to a liquid ejecting head and a liquid ejecting apparatus, and it is a matter of course that the invention can also be applied to a liquid ejecting head and a liquid ejecting apparatus that eject liquid other than ink. Examples of other liquid ejecting heads include various recording heads used in image recording apparatuses such as a printer, a coloring material ejecting head used in manufacturing a color filter of a liquid crystal display or the like, an electrode material ejecting head used in forming an electrode of an organic EL display, a field emission display (FED), or the like, and a bioorganic substance ejecting head used in manufacturing a biochip. Also, the invention can be applied to liquid ejecting apparatuses provided with such liquid ejecting heads.

What is claimed is:

1. A liquid ejecting head comprising:

a pressure chamber substrate that includes a plurality of pressure generation chambers;

a nozzle plate that includes a plurality of nozzle openings; and a plurality of communication paths connecting the respective pressure generation chambers and the respective nozzle openings and have oblique portions with section areas changing from inlets on a side of the pressure generation chambers toward outlets on a side of the nozzle openings, wherein the oblique portions are arranged in the communication paths on the side of the pressure generation chambers or the side of the nozzle openings in a third direction such that the oblique portions are between the pressure chambers and the nozzle openings in a direction of liquid flow in the communication paths, wherein the plurality of pressure generation chambers are aligned in a first direction and include a first pressure generation chamber and a second pressure generation chamber that are adjacent to each other in the first direction, wherein the first pressure generation chamber communicates with a first nozzle opening from among the nozzle openings via a first communication path from among the plurality of communication paths, wherein the second pressure generation chamber communicates with a second nozzle opening from among the nozzle openings via a second communication path from among the plurality of communication paths, wherein the first communication path includes, on one side of a second direction, a first oblique portion with a section area changing from a side of the first pressure generation chamber toward the first nozzle opening, wherein the second communication path includes, on the other side of the second direction, a second oblique portion with a section area changing from a side of the second pressure generation chamber toward the second nozzle opening, wherein the first direction is orthogonal to the second direction on the nozzle plate, wherein the third direction is a direction orthogonal to both the first direction and the second direction, wherein the communication paths are provided in a substrate sandwiched between the pressure chamber substrate and the nozzle plate, wherein the first oblique portion has a section area reduced from the side of the first pressure generation chamber toward the side of the first nozzle opening, wherein the second oblique portion has a section area reduced from the side of the second pressure generation chamber toward the side of the second nozzle opening, wherein the first communication path includes, on a downstream side of the first oblique portion, a first linear portion with a uniform section area from the side of the first pressure generation chamber toward the side of the first nozzle opening, and wherein the second communication path includes, on a downstream side of the second oblique portion, a second linear portion with a uniform section area from the side of the second pressure generation chamber toward the side of the second nozzle opening.

2. The liquid ejecting head according to claim 1, wherein one of an inlet and an outlet of each communication path is arranged inside the other in a plan view from the third direction.

3. The liquid ejecting head according to claim 1, wherein a clearance between the first nozzle opening and the second nozzle opening is wider than a clearance between the first pressure generation chamber and the second pressure generation chamber in the second direction.

4. The liquid ejecting head according to claim 1, wherein the plurality of communication paths are provided on a substrate laminated on the pressure chamber substrate.

5. The liquid ejecting head according to claim 1, further comprising:

a communication plate in which the communication paths are provided;

a manifold substrate that is laminated on the communication plate and includes a manifold communicating with the plurality of pressure generation chambers; and a plurality of supply communication paths that establish communication between the manifold and the pressure generation chambers, wherein the first pressure generation chamber communicates with the manifold via a first supply communication path from among the plurality of supply communication paths, wherein the second pressure generation chamber communicates with the manifold via a second supply communication path from among the plurality of supply communication paths, and wherein a clearance between the first supply communication path and the second supply communication path is wider than a clearance between the first pressure generation chamber and the second pressure generation chamber in the second direction.

6. A liquid ejecting apparatus comprising:

the liquid ejecting head according to claim 1.

7. A liquid ejecting apparatus comprising:

the liquid ejecting head according to claim 2.

8. A liquid ejecting apparatus comprising:

the liquid ejecting head according to claim 3.

9. A liquid ejecting apparatus comprising:

the liquid ejecting head according to claim 4.

10. A liquid ejecting apparatus comprising:

the liquid ejecting head according to claim 5.

* * * * *